US005580383A

United States Patent [19]

Ikegaya et al.

[11] Patent Number: 5,580,383

[45] Date of Patent: Dec. 3, 1996

[54] SURFACE TREATMENT APPARATUS AND METHOD

[75] Inventors: Hirohiko Ikegaya; Masaaki Isobe; Seishi Watanabe, all of Iwata, Japan

[73] Assignee: Yamaha Hatsudoki Kabushiki Kaisha, Iwata, Japan

[21] Appl. No.: 299,518

[22] Filed: Sep. 1, 1994

[30] Foreign Application Priority Data

Sep. 2, 1993 [JP] Japan ..... 5-218754
Jun. 16, 1994 [JP] Japan ..... 6-134713

[51] Int. Cl.[6] ..... B05B 13/06

[52] U.S. Cl. ..... 118/317; 118/306; 204/224 R; 204/237

[58] Field of Search ..... 118/306, 317, 118/305, 500, 503; 204/237, 224 R

[56] References Cited

U.S. PATENT DOCUMENTS 4,441,976 4/1984 Iemmi et al. ..... 204/224 M
4,853,099 8/1989 Smith ..... 204/224 R

FOREIGN PATENT DOCUMENTS 2685924 7/1993 France .
3937763 1/1993 Germany .

OTHER PUBLICATIONS

European Search Report dated Dec. 27, 1994.
Patent Abstract of Japan, vol. 10, No. 172, 6–18–86 & JP–A–61 23 785 (Kiyouritsu K. K.).
Patent Abstract of Japan, vol. 17, No. 678, 12–13–93 & JP–A–05 222 589 (Toyota Motor Corp).

*Primary Examiner*—Donald E. Czaja
*Assistant Examiner*—Calvin Padgett
*Attorney, Agent, or Firm*—Knobbe, Martens, Olson & Bear

[57] ABSTRACT

An improved surface treatment system, assembly, workstation, method, and liquid for plating and the like. The assembly includes a member defining a fluid passage within the interior surface of a workpiece which is connected to a treating liquid feed channel and a treating liquid discharge channel. Desirably, the assembly includes a sealing mechanism at least partially insertable into the opening of the sealing mechanism to avoid leakage.

15 Claims, 25 Drawing Sheets

SURFACE TREATMENT APPARATUS AND METHOD

FIELD OF THE INVENTION

This invention relates to surface treatment methods and devices and, in particular, to such methods and devices used in the process of nickel plating the interior surfaces of cylinders of internal combustion engine blocks.

BACKGROUND OF THE INVENTION

Historically, plating processes were relatively slow and, therefore, were not possible in a general assembly line environment. Accordingly, parts to be plated were removed from the assembly line, transported to plating treatment locations and later retransported and replaced on the assembly line.

Recently, however, high speed plating methods have been developed. For example, Japanese Patent Publication No. 1-52,480 discloses a surface treatment device for degreasing the inside surface of the cylinder of an engine prior to chrome plating. During the process, both ends of the engine cylinder are plugged with a plug through a sealing material. One of the plugs defines a passage for the entry of treating liquid, while the other plug defines a treating liquid exit passage. Both passages are in fluid communication with the inside of the cylinder. A tank for the treating liquid, a pump, and valves are connected to a piping system for purposes of recirculating the treatment liquid from a treatment liquid reservoir through the engine cylinders and returning the treatment liquid to the reservoir. The flow of the treating liquid through the inside of the cylinder permits a higher current density to be applied to the liquid, resulting in higher plating rate.

On the other hand, this and other high speed plating devices have significant limitations. For example, in the above-described device, experience has shown that it is difficult to completely prevent the leakage of treating liquids from the inside of the cylinder. Specifically, due to the varying sizes of the walls of the crank chamber and their proximity to the cylinders being plated, it is difficult to properly seal the cylinders against leakage. Such leakage can adversely affect the quality of the plating of the cylinder, as well as result in the deposition of plating treatment liquid on the outside of the cylinder. It also poses a safety risk.

Thus, there is needed an improved surface treatment device and, in particular, an improved surface treatment device suitable for use in plating the cylindrical walls of engine blocks.

SUMMARY OF THE INVENTION

Applicant's invention is an improved plating treatment system including an improved fluid transfer assembly and workstation.

An important aspect of Applicant's invention is an assembly for treating an interior surface of a workpiece, wherein the interior surface of the workpiece forms a first opening and a second opening, including a body, a sealing surface connected to the body, a member, a treating liquid feed channel, a treating liquid discharge channel, a source of pressure, and a sealing mechanism. The body defines the support to which a workpiece is mountable. The sealing surface is connected to the body to form a seal around the first opening when the workpiece is secured to the support. The member defines a fluid passage for treating liquid to flow within an interior surface of a workpiece mounted on the support. The fluid passage defines a treating liquid feed end and a treating liquid discharge end. The treating liquid feed channel is connected to the treating liquid feed end of the member, and the treating liquid discharge channel is connected to the treating liquid discharge end of the member. A source of pressure communicates with one of the feed channel and discharge channel to circulate liquid within the assembly. The sealing mechanism is at least partially insertable into the second opening. Desirably, the sealing mechanism includes a sealing element expandable radially outward to form a seal with the interior surface of the workpiece.

Yet another important aspect of the invention is a surface treatment assembly for performing a surface treatment to an inside peripheral surface of a cylindrical portion of a workpiece, including a body, a member, a treating liquid feed channel, a fluid passage discharge channel, means for pressurizing treating liquid, a sealing element, and a seal operating means. The body includes a support for supporting a workpiece such that an opened portion of one side of the cylinder of the workpiece is closed. The member defines a fluid passage provided for treating liquid within the inside of the cylindrical portion of the work. The treating liquid feed channel communicates with the fluid passage and a treating fluid discharge channel communicates with the fluid passage. Liquid within the treating liquid feed channel is pressurized by the means for pressurizing the treating liquid. The sealing device is attached to the end of the member to cooperate with an opening opposite an opening adjacent the support. The seal operating means imparts an outwardly expanding force to the sealing device to maintain the outer periphery of the sealing device in pressure engagement with the inside periphery of the cylindrical portion of the workpiece.

DETAILED DESCRIPTION OF THE PREFERRED EMBODIMENT

Figure 1:
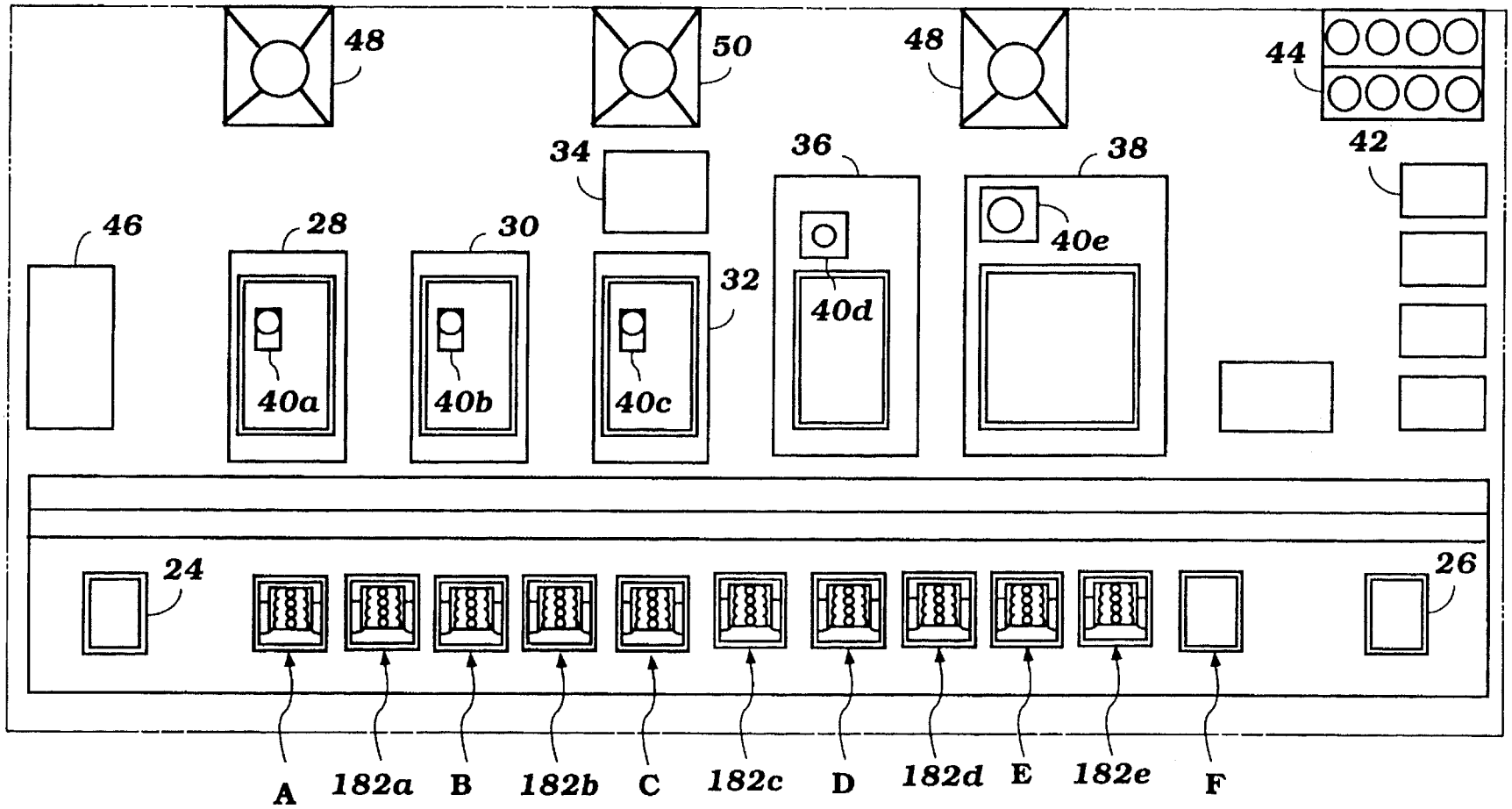
FIG. 1 is a plan view schematically illustrating the plating treatment system of the present invention.
Figure 2:
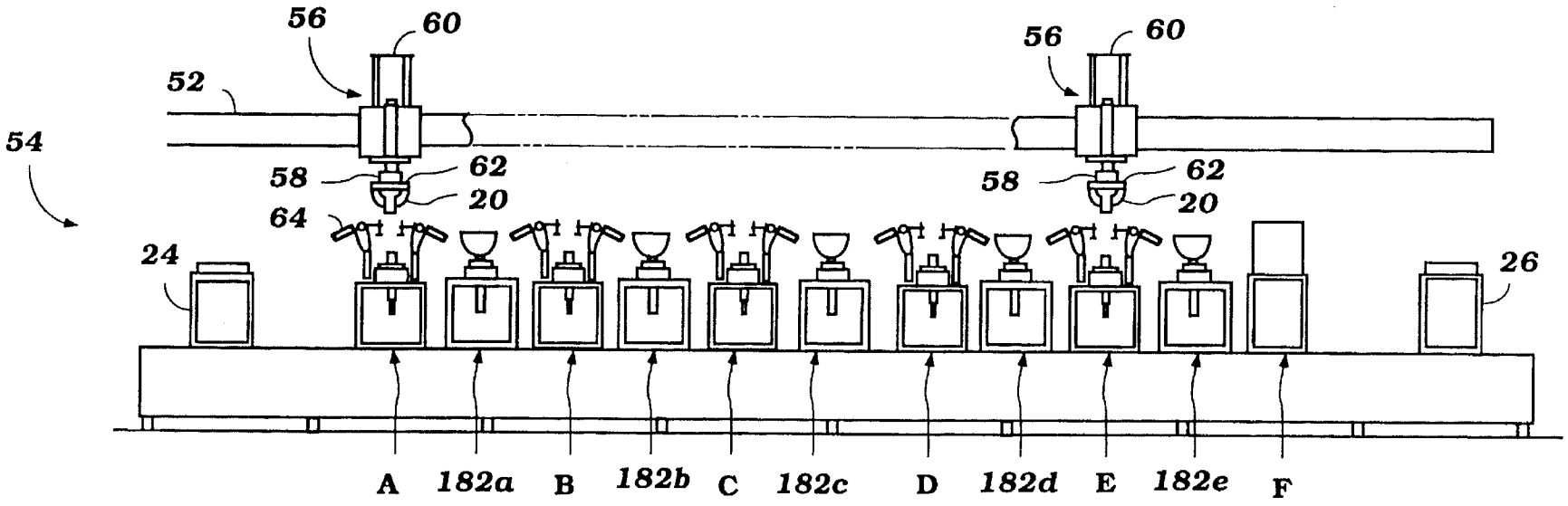
FIG. 2 is a schematic elevational view illustrating the plating treatment system of FIG. 1.

FIGS. 1 and 2 schematically illustrate the plating treatment system of the present invention in connection with a system for plating a cylinder block 20 having a plurality of cylinders 22 (FIG. 6), each of which defines an inner cylindrical surface which is to be plated. It will be appreciated, however, that the system, device, and method of the present invention are not limited to use in plating cylinder blocks or the specific type of plating herein disclosed.

For purposes of clarity, an overview of the entire system will first be described. After this general framework is provided, the fluid transfer assembly which transfers liquid to and from each individual workstation will be described. The description will then focus on a individual plating workstation and general operation, as well as an individual pretreatment workstation. Thereafter, various alternative embodiments of the system, fluid transfer assembly and workstations will be discussed.

FIGS. 1–2 illustrate a system particularly adapted to perform a high speed plating process incorporating nickel and, as a dispersing agent, silicon carbide and phosphorous. This plating material is desirable for reasons of hardness and resistance to baking of the inside of the cylinder, as will be discussed below in greater detail.

System Overview

The system utilizes a number of treatment workstations A–D for various pretreatments, a plating workstation E, and a drying workstation F. These workstations are positioned along a plating process assembly line in an order corresponding to the order in which the operations are performed. Specifically, the system incorporates a degreasing treatment workstation A, an alkali etching treatment workstation B, a mixed acid etching treatment workstation C, an alumite treatment workstation D, a high-speed plating workstation E, and a drying workstation F. Desirably, the line also includes a workpiece feeding workstation 24 at the beginning of the plating treatment line and a workpiece delivery workstation 26 at the end of the plating treatment line.

Desirably, the workstations A–E are connected to respective liquid storage reservoirs by appropriate fluid communication lines. Specifically, the treatment line is provided with a degreasing liquid storage tank 28, an alkali liquid storage tank 30, a mixed acid liquid storage tank 32, a mixed acid exhaust liquid tank 34, an alumire liquid storage tank 36, and a plating liquid storage tank 38. Treating liquid supply pumps 40*a–e* are desirably provided between respective treating liquid tanks 28–38 and the corresponding treatment workstations A–E. In addition, the treatment line is provided with rectifiers 42, an ion exchanger 44, a control panel 46, air exhaust fans 48, and a nitrogen oxide cleaner 50.

As seen in FIG. 2, a support shaft or beam 52 extends above a workpiece transfer line 54. A plurality of workpiece transporting devices 56 are movably mounted along the beam 52, each of which is provided with a vertically reciprocable chuck 58 and a device 60 for moving the chuck up and down. The transporting devices 56 are moved along the beam 52 by a drive motor (not shown). A jig 62 is mounted on each cylinder block 20 to facilitate the transfer of the jig and cylinder block by the transfer device 56.

Each of the workstations is further provided with a position-determining apparatus and clamp 64 to position and clamp the cylinder block 20 with respect to the workstation.

Fluid Transfer Assembly for Workstation

Figure 3:
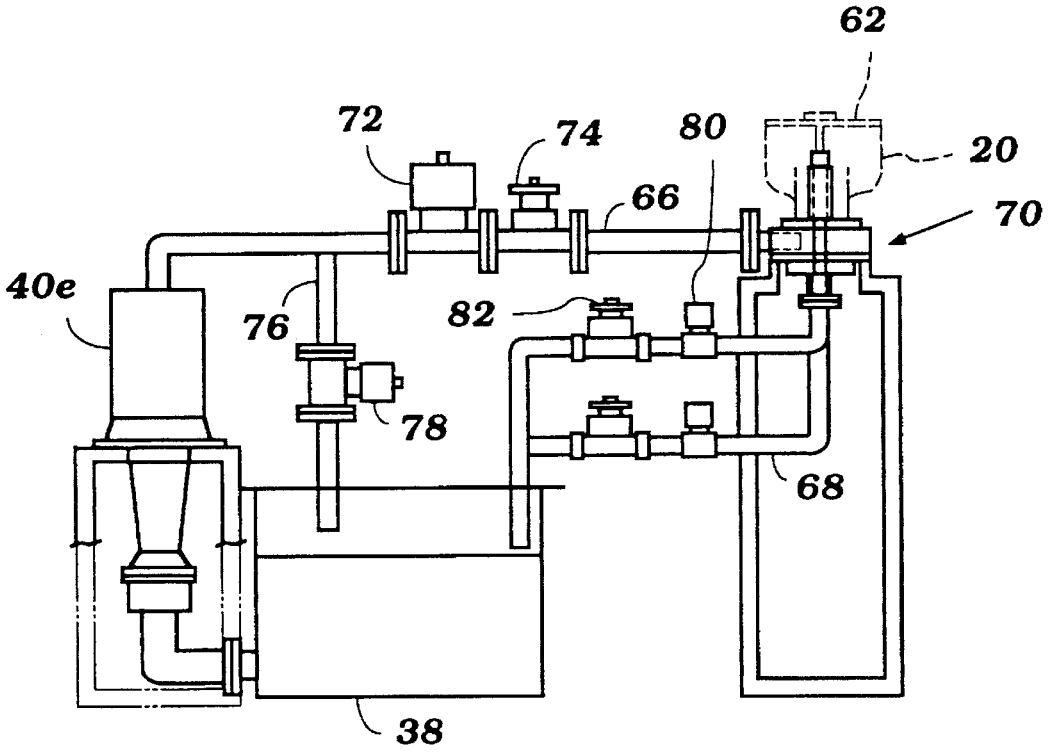
FIG. 3 is a schematic view illustrating the fluid transfer assembly of a plating workstation of the system of FIG. 1.
Figure 4:
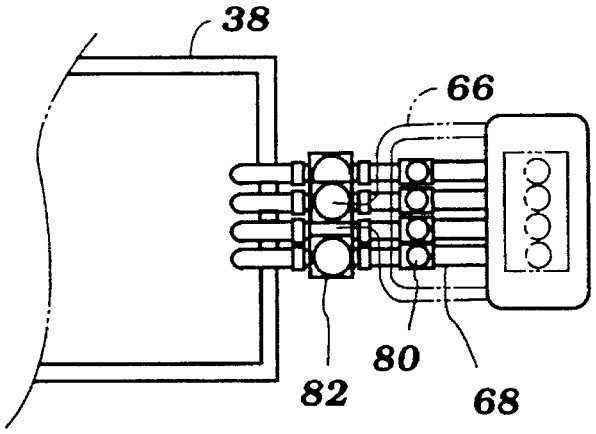
FIG. 4 is a plan view illustrating a portion of the assembly of FIG. 3.

Referring to FIGS. 3 and 4, the fluid transfer assembly of the high speed plating system will now be described. A treating liquid feed channel or pipe 66 and a treating liquid recovery channel or pipe 68 are provided between a treatment device or workstation main body 70 having a support for a workpiece at the upper end thereof and the treating liquid tank or reservoir 38. The pump 40*e* is connected to the reservoir 38. The treating liquid feed pipe 66 has an upstream end connected to the pump 40*e* and two branch downstream ends connected to a hereinafter described treating liquid feeding path of the treatment workstation main body 70. The treating liquid recovery pipe 68 has an upstream end connected to a hereinafter described treating liquid discharge path of the workstation main body 70 and a downstream end extending to the treating liquid reservoir 38. In the illustrated embodiment, there are provided four juxtaposed treating liquid recovery pipes 68, as would be desirable for plating a cylinder block for a four-cylinder engine.

The treating liquid feed pipe 66 is provided with a main automatic valve 72 and a main manual valve 74 for adjusting the feed rate of the treating liquid. The feed pipe 66 is also provided with a bypass branch 76 therefrom at a position upstream of the valves 72 and 74 extending to the treatment fluid reservoir 38 for returning superfluous liquid to the tank. The bypass 76 is provided with a bypass automatic valve 78. The treating liquid recovery pipe 68 is provided with a flow rate sensor 80 and a flow rate controlling valve 82 for adjusting the flow rate of the recovered liquid.

Plating Workstation

Figure 5:
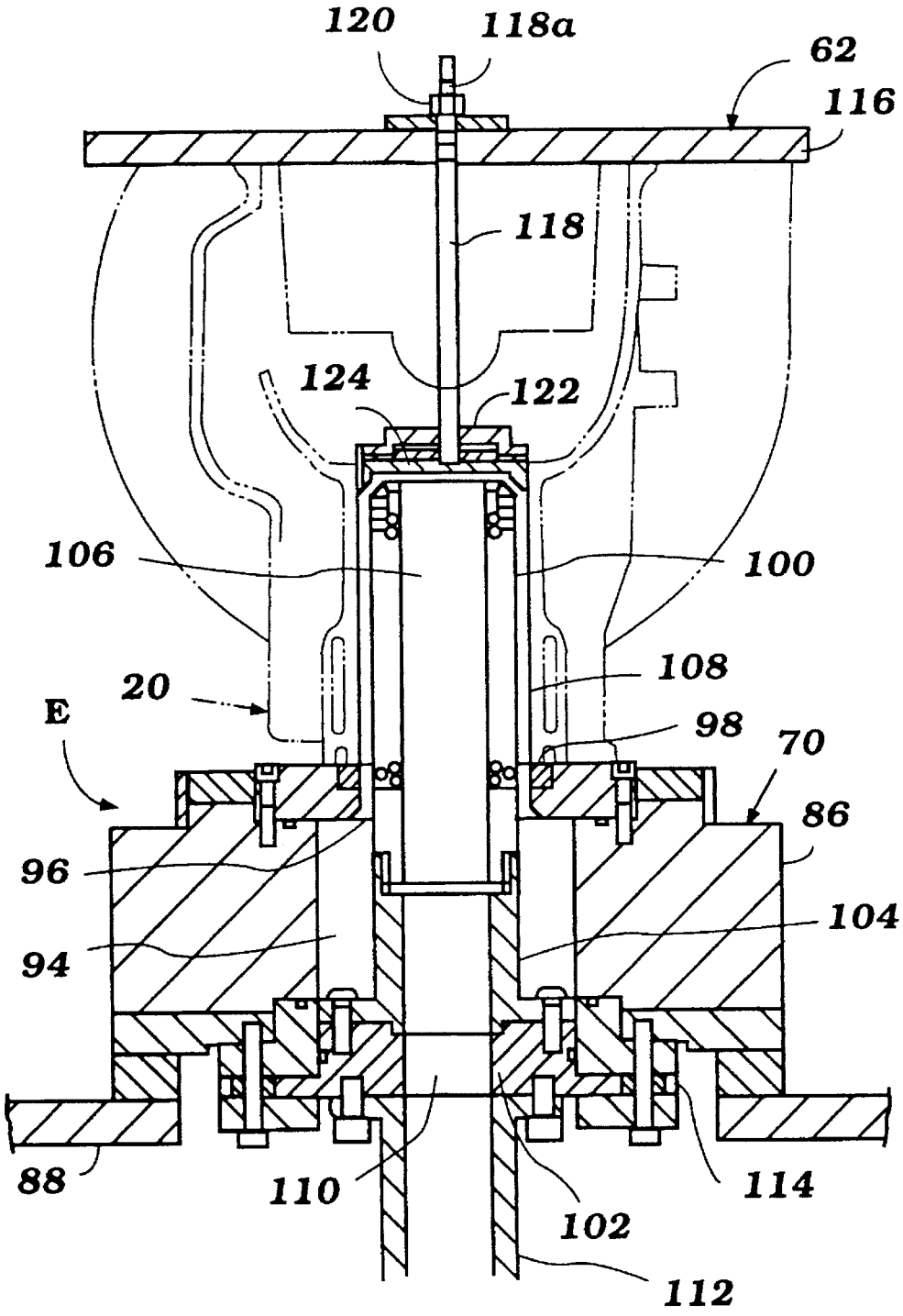
FIG. 5 is an elevational, vertical cross-sectional view showing one embodiment of a surface treatment device according to the present invention applied to a plating workstation.
Figure 6:
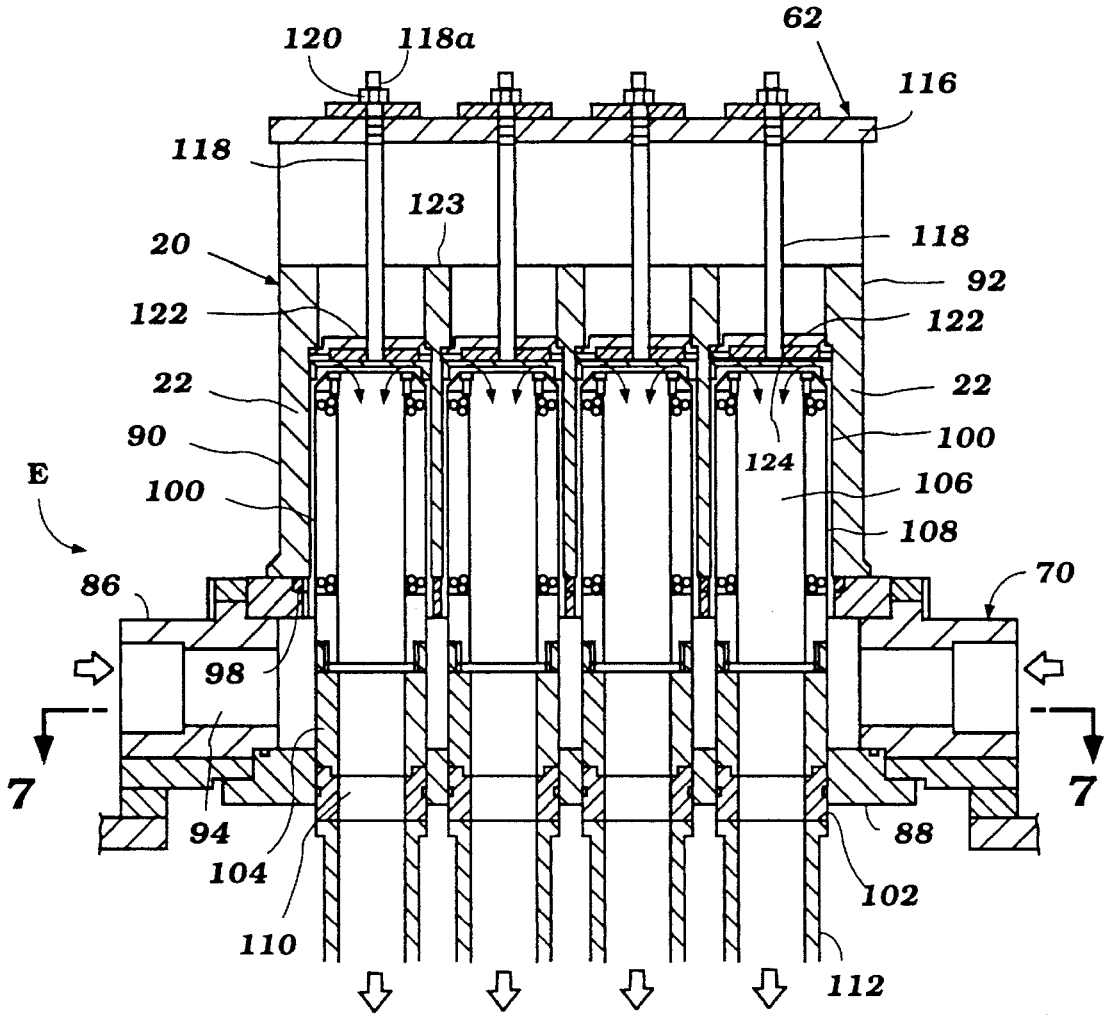
FIG. 6 is a vertical cross-sectional side view of the surface treatment device of FIG. 4.
Figure 8:
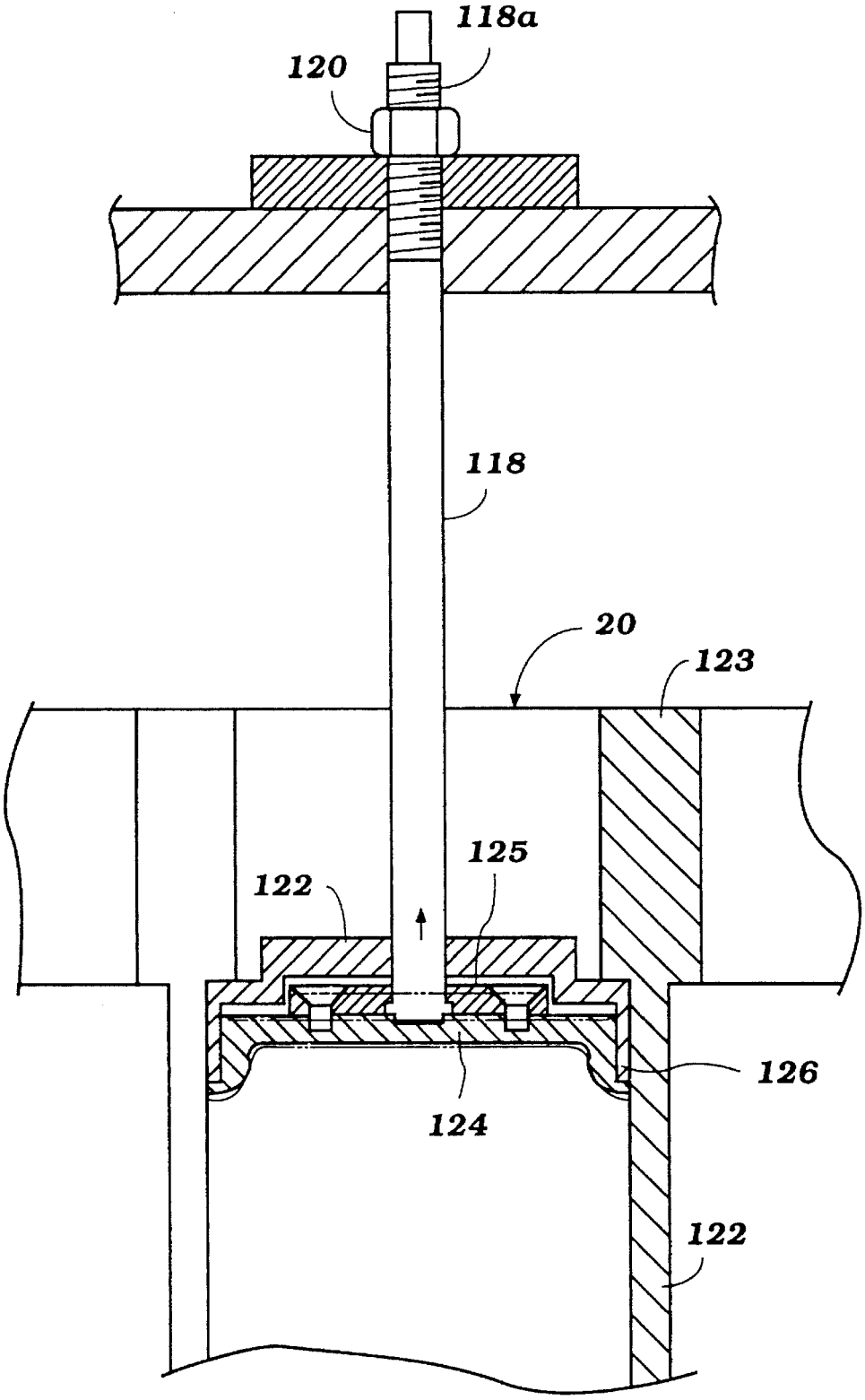
FIG. 8 is an enlarged sectional view illustrating the sealing mechanism of the workstation of FIG. 7.

FIGS. 5, 6 and 8 illustrate a detailed structure of the plating workstation E. A work support portion or supporting block 86 is mounted on a base table 88 of the workstation main body 66. The cylinder block 20 is adapted to be supported on the supporting block 86, with both open portions of each cylinder 22 maintained in a predetermined vertically oriented state. Specifically, the cylinder block 20 has a unitary structure composed of a cylinder-defining portion 90 defining four cylinders 22 and a skirt-like crankcase portion 92. The cylinder block 20 is inverted from the position it will be mounted in the automobile, and the jig 62 is connected to the upper end of the crankcase.

The supporting block 86 defines a laterally extending (in the direction along which the cylinders are arranged) treating liquid feed path 94 positioned beneath the cylinder portion 90 of the cylinder block 20. Both ends of the liquid feed path 94 are connected to the treating liquid feed pipe 66 (see FIG. 3). The support block 86 defines a series of openings 96 corresponding to the position of each of the cylinders, which is in fluid communication with the treating liquid feed path 94. A seal portion 98 is provided around the periphery of each opening 96. Accordingly, as will be appreciated, when the cylinder block 20 is mounted on the supporting block 86, the lower end of each cylinder (head side of the cylinder) coincides with the corresponding opening 96 in the mounting block with the peripheral edges of each cylinder in sealing engagement with the seal portion 98.

The body of the workstation E includes an electrode 100, which also functions as a fluid passage defining member. Each of the electrodes 100 is positioned to correspond to the position of each of the cylinders 22 of the cylinder block 20. The electrodes 100 are likewise formed in a cylindrical shape and are mounted on a holder 102, which in turn is mounted on the table 88 to a mounting member 104. Each electrode 100 extends through the treating liquid feed path 94 and protrudes upward from the corresponding opening 96. Accordingly, when the cylinder block 20 is mounted on the support block 86, each of the electrodes 100 is positioned within a corresponding cylinder 22 of the cylinder block so that the upper end of each electrode is positioned adjacent to an upper end of the cylinder bore with a predetermined space being defined between the outer peripheral surface of the electrode and the inside cylindrical surface defined by the cylinder. As a result, inner and outer cylindrical passages 106, 108 are defined inside and outside each electrode. These inner and outer fluid passages 106, 108 communicate with one another at the upper ends thereof. Furthermore, the outer fluid passage 108 is in fluid communication with the treating liquid feed path 94.

Figure 7:
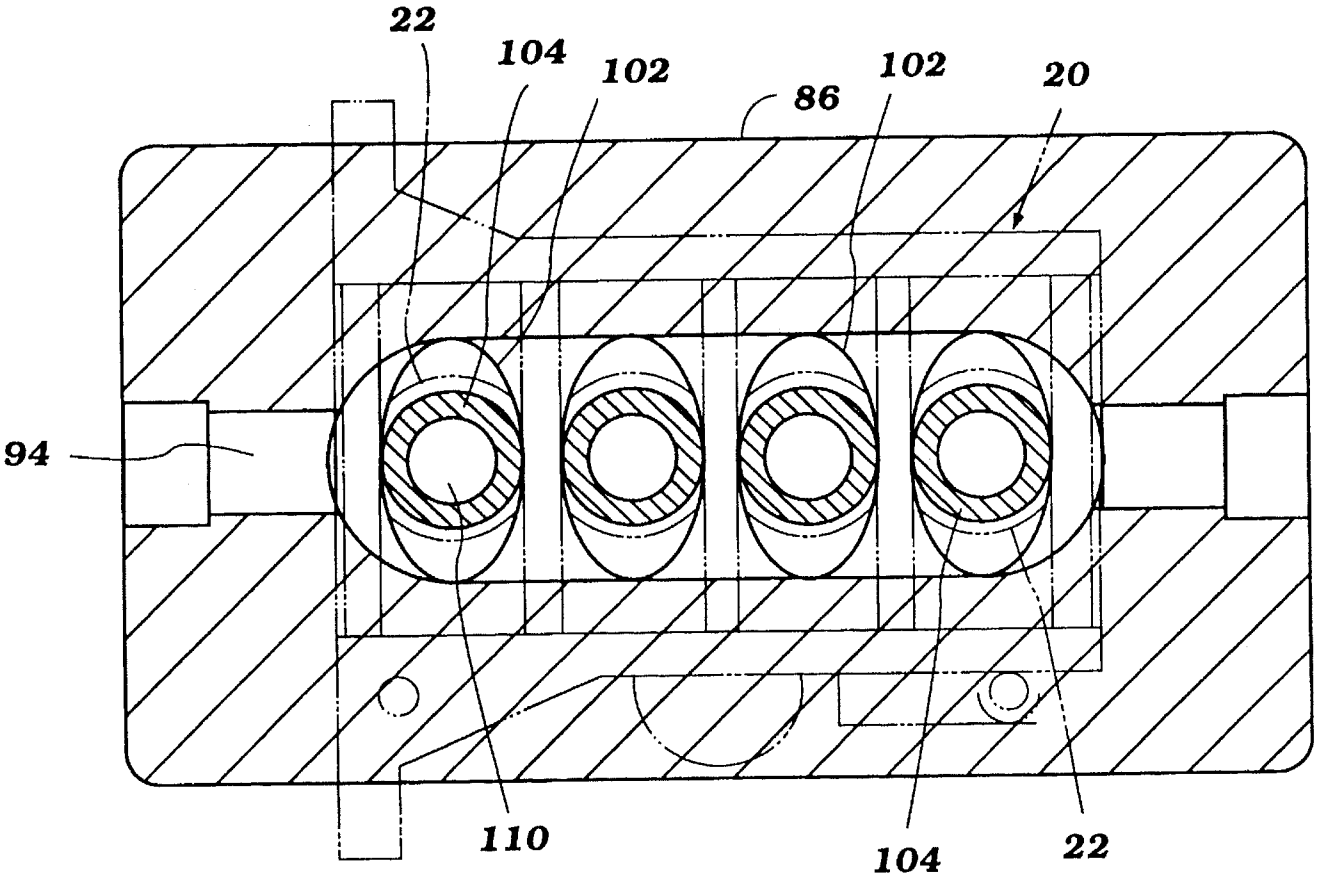
FIG. 7 is a sectional view of the surface treatment device taken along line VII—VII of FIG. 6.

Each of the holders 102 is provided with a through hole which constitutes, together with the inside face of the mounting member 104, a treating liquid discharge path 110 which is in fluid communication with the passage 106 formed within the electrode 100. Each treating liquid discharge path 110 is connected to a respective treating liquid recovery pipe 68 through a connecting pipe 112. The mounting member 104, holder 102, and connecting pipe 112 are formed of an electrically conductive material and are electrically connected to a rectifier. As will be appreciated, to properly orient the electrode, each holder 102 must be precisely positioned with respect to the corresponding cylinder 22 of the cylinder block 20. Further, the electrodes 100 are required to be electrically separated from one another. Thus, as shown in FIG. 7, each of the holders 102 is shaped into an ellipse with the long axis being oriented in a direction normal to the shorter axis and having a flange 114 extending outward from each end of the longer axis side and fixed to the base table 88 by bolts. The mounting member 104 is fixedly secured to the longer axis sides of the holder 102 by bolts.

The jig 62 connected to the cylinder block 20 is provided with a plate 116 which is in abutting engagement with an upper open portion of the cylinder block. The jig 62 is provided with a seal element adapted to be inserted into the upper opening (the crankcase side opening) of each of the cylinders 22. Thus, the support block 86 seals off the lower openings of the cylinders 22 and the seal elements seal off the upper end of the cylinders. Advantageously, the seal element may be actuated by exerting a force creating an outward expansion of the seal element. Application of such force will maintain the outer periphery of the seal element in sealing engagement with the inside periphery of the cylinder (the inner cylindrical surface).

If washing water is not provided to a work station, washing stations may be disposed between each respective adjacent treatment workstation A–E and between the plating treatment section E and the drying section F.

This sealing mechanism may take the form illustrated in FIGS. 5, 6, and 8. Specifically, the jig 62 is provided with the plate 116 which engages the upper end of the cylinder block 20. A rod 118 extends downward from the plate 116 into the mouth of each of the cylinder openings. The rod 118 is vertically reciprocal relative the plate 116 and can be mounted by means of a fastener or nut 120 which engages with the upper end of the rod, which may be adapted for this purpose with, for example, external threads 118*a*. The lower end of the rod is advantageously provided with an engaging plate 122 defining a central aperture which is movably reciprocal relative to the rod 118. The vertical movement of the engaging plate 122 is limited by the crankshaft supporting wall 123 extending from the cylinder wall. A seal pressing plate 124 is fixedly mounted to the lower end of the rod 118 by means of a separate clamp plate 125, secured to the seal pressing plate by fasteners such as screws. An O-ring 126 is mounted between the seal pressing plate 124 and engaging plate 122 and can be forced into sealing engagement with the inner surface of the cylinder by exerting an upward force, as shown in the arrow in FIG. 8.

In connecting the cylinder block 20 and the jig 62, the engaging plate 122, the seal pressing plate 124 and the O-ring 126 are first fitted into the upper opening of each of the cylinders of the cylinder block. The upper end portion 118*a* of each of the rods 118 is inserted into the through-hole of the plate 116 and is threadingly engaged with the nut 120. The nut 120 is rotated to move the rod 118 upward and to displace the pressing plate 124 from the position shown by the phantom line in FIG. 8 to the position shown in the solid line in FIG. 8. The resulting vertical compression of the O-ring 126 by the engaging plate 122 and seal pressing plate 124 forces the O-ring to expand outward into pressurized sealing engagement with the inner cylindrical surface of the cylinder 22. In this manner, each of the cylinders 22 may be properly sealed, without interference from the crankcase portion 92 of the cylinder block 20. Likewise, plating fluid is prevented from escaping from the upper opening of the cylinder 22 so that spillage is prevented.

The assembly is then set on the supporting block 86 of the workstation body 70. Thereafter, the plating liquid is fed and recirculated according to the piping system shown in FIG. 3. At the same time, the electrode 100 shown in FIGS. 5 and 6 is energized to effect a high speed plating of the interior surface of each of the cylinders 22 of the cylinder block 20. That is, the plating liquid is fed from the treating liquid feed pipe 66 to the treating liquid feed path 94 in the supporting block 86 and a thin path as shown by the arrow in FIG. 6 through the passage 108 defined between the electrode 100 outer periphery and the inside surface of the cylinder 22 to the passage 106 of the inside of the electrode via the upper space of the cylinder. The plating liquid is then allowed to flow through the treating liquid discharge path 110 to the treating liquid recovery pipe 68 and then is returned to the treating liquid tank 38. While the plating liquid is recirculated in this manner, the plating liquid flows within the cylinder 22 along the inside peripheral surface of the cylinder to be plated. By establishing a voltage between the electrode 100 and the inside peripheral surface of the cylinder 22, a high speed plating is effected.

Figure 9:
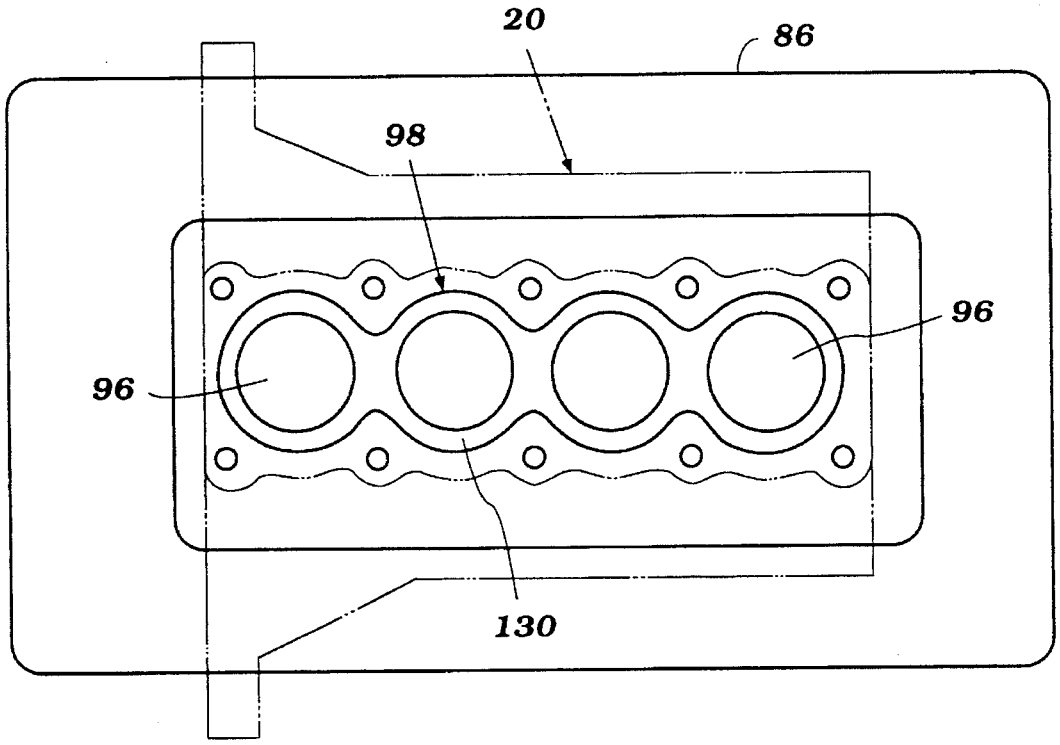
FIG. 9 is a plan view of showing an embodiment of the sealing portion of the supporting block of the work station of FIG. 4.
Figure 10:
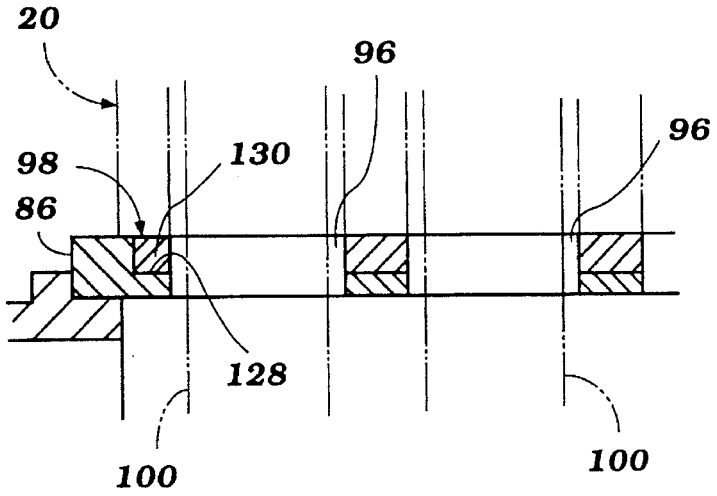
FIG. 10 is a sectional view of the sealing portion of FIG. 9.

FIGS. 9 and 10 illustrate one embodiment of the sealed portion 98 between the upper surface of the support block 86 and the lower end of the cylinder block 20. Referring to FIGS. 9 and 10, a recessed step 128 is formed around the periphery of each open portion 96 of the support block 86. A seal member 130 formed from a predetermined number of interconnected annular flat packings is fitted into the recess portion 128 to form the seal 98. The engagement of the seal member 130 with the lower end surface of the cylinder block 20 prevents leakage of treating liquid and damage to the lower end surface of the cylinder block.

Figure 11:
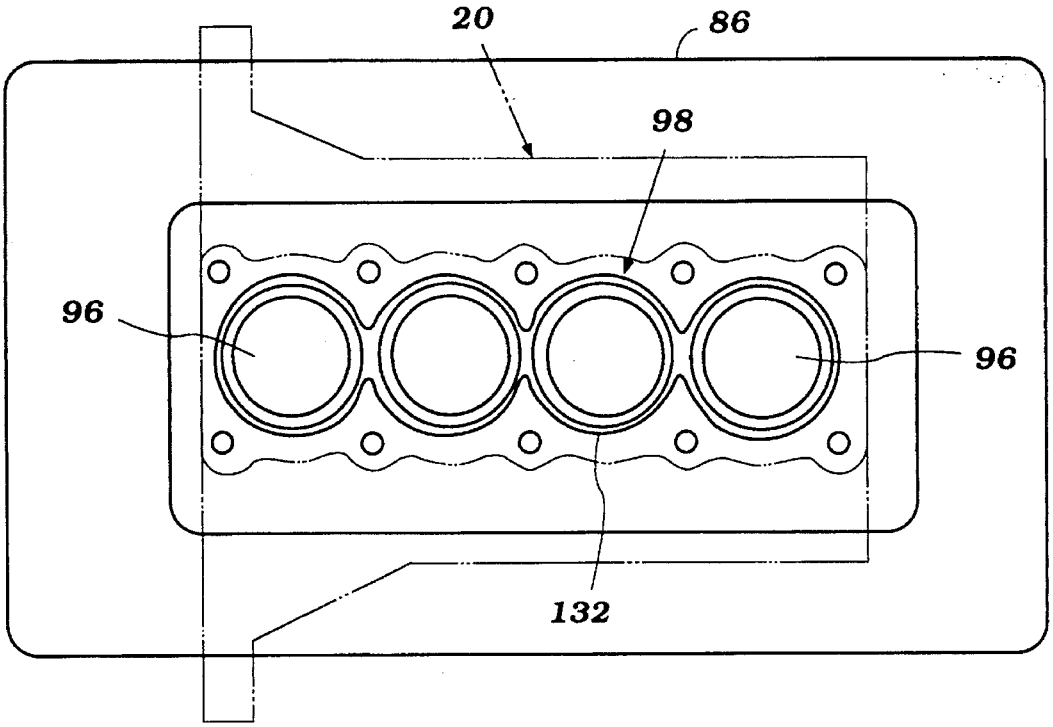
FIG. 11 an alternative embodiment of the sealing portion of a support block of a surface treatment device.
Figure 12:
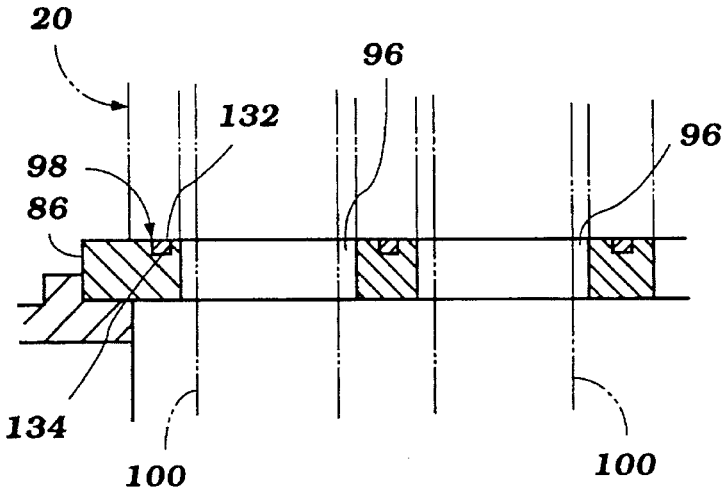
FIG. 12 is a sectional view of the sealing portion of the support block of FIG. 11.

FIGS. 11 and 12 illustrate an alternative embodiment of the seal member 98. Here, the seal member 98 is formed from a predetermined number of interconnected O-rings 132 fitted into an annular groove 134 formed around each of the openings 96 on the upper side of the support block 86. Engagement of the seal 98 and the upper surface of the support block 86 surrounding the cylinder prevents leakage of treating fluid and damage to the lower end surface of the cylinder block 20.

Alternative Fluid Delivery System

Figure 13:
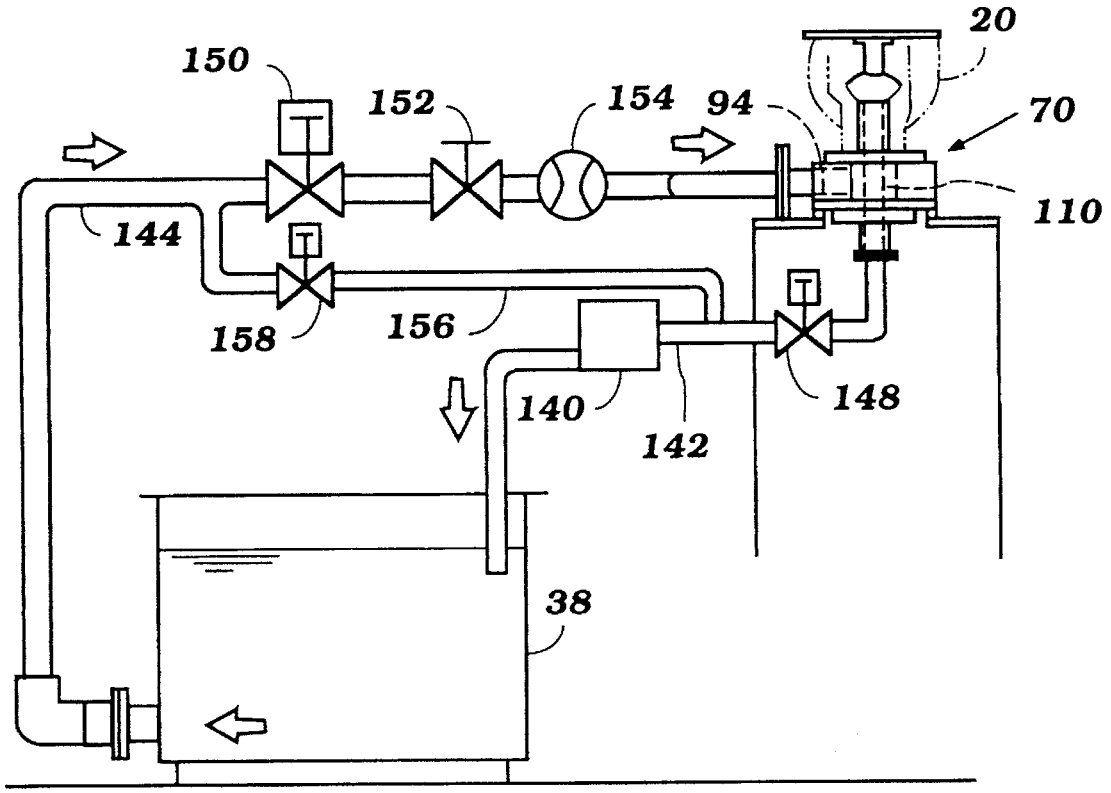
FIG. 13 is an alternative embodiment of the fluid transfer assembly of the present invention.

FIG. 13 depicts an alternative embodiment of the treating liquid feed and discharge mechanism. In the illustrated embodiment, a self-feeding-type pump 140 having high suction power is used as a suction device disposed in the liquid recovery pipe 142. Significantly, the suction provided by the pump 140 is sufficient both to generate sufficient flow rates in the recovery pipe 142, as well as the feed pipe 144 of the system. The fluid flows from the body 70 of the workstation, through the discharge path 110, through the high suction pump 140, and to the treatment fluid reservoir 38. A flow rate control valve 148 is positioned intermediate the treating liquid discharge path 110 and the high suction pump 140. The treating liquid feed pipe 144 extending between the reservoir 38 and the treating liquid feed path 94 of the workstation main body 70 is provided with an automatic valve 150, a manual valve 152, and a flow meter 154. A bypass flow path 156 is also provided directly connecting the treating liquid feed path 94 with the treating liquid recovery pipe 142. An automatic valve 158 is positioned along the bypass flow path 156 between the feed pipe 144 and the recovery pipe 142.

In operation, the treating liquid is sucked through the entire system by the high suction force of the pump 140. Advantageously, since no pressure is applied to the treating liquid flow passages 106 and 108, the risk of overflow of the plating liquid from the upper openings of the cylinder 22 of the cylinder block 20 is substantially minimized. Additionally, the provision of a bypass passage 156 and an automatic valve 158 makes it possible to quickly stop the feed and discharge of the treating liquid to and from the workstation main body 70 by opening the automatic valve to permit treating liquid to flow through the bypass passage when the plating treatment is stopped.

The Pretreatment Workstation

The teachings of this embodiment are equally applicable to pretreatment workstations. For example, referring to FIGS. 14 and 15, a support block 160 may be mounted on a base table 162 of a workstation main body 164 in the same manner as previously described. The support block 160 is provided with a treating liquid feed path 166 connected to a treating liquid feed pipe (not shown). A cylindrical fluid passage-defining member 168 is disposed at a position corresponding to each of the cylinders 22 of the cylinder block 20. The fluid passage-defining member 168 may have nearly the same shape and arrangement as the electrode 100 of the plating treatment workstation E and protrudes through an opening 169. Specifically, the fluid passage-defining member 168 is inserted into each of the cylinders 22 through an opening to form outer and inner fluid passages 170, 172. This fluid passage-defining member 168 is advantageously fixed to the base table 162. The base table 162 is provided with a treating liquid discharge path 174 which is in fluid communication with the fluid passage 172 on the inside of each of the fluid passage-defining members 168, a communication passage 176 which is in fluid communication with a corresponding port 178, and an outlet passage 180 which is in fluid communication with the communication passage and extends downward. A treating liquid recovering pipe 68' is connected to the treating liquid discharge path 174.

In operation, the cylinder block 20 and jig 62 are mounted on the support block 162 and an injection nozzle is provided on the work supporting portion of the support block at a position corresponding to each of the cylinders. By injecting washing water in this manner, water is allowed to pass through the fluid passages 170, 172 along the inner cylindrical surface of the cylinder. Advantageously, by injecting washing water from respective injection nozzles into the corresponding cylinders 22 of the cylinder block 20, the water washing operation can be efficiently performed in one step. Previously, such an operation was typically carried out by immersing the work successively in a plurality of water washing vessels. Accordingly, the present invention permits the water washing operation time to be shortened and the space for water washing workplace is to be reduced.

Due to the nature of the plating liquid, it is particularly desirable to avoid leakage of plating fluid during the plating treatment process. On the other hand, the concerns with leakage are not as great for pretreatment workstations. Accordingly, it would be possible to manufacture the piping system without a suction pump 140, thereby incurring a greater risk of leakage.

Figure 16:
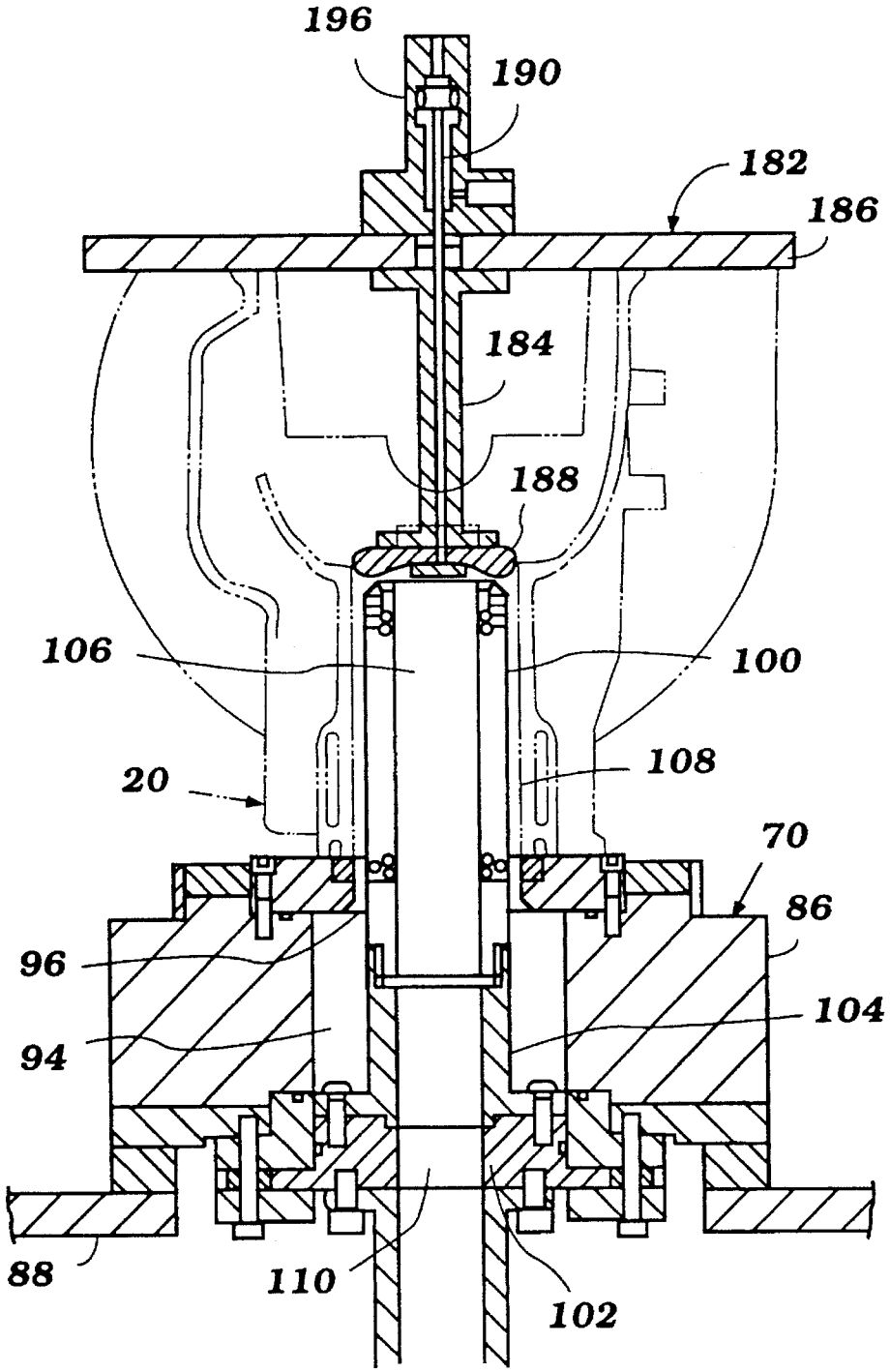
FIG. 16 is a vertical, cross-sectional front view of an alternative embodiment of the pretreatment workstation of the present invention.
Figure 17:
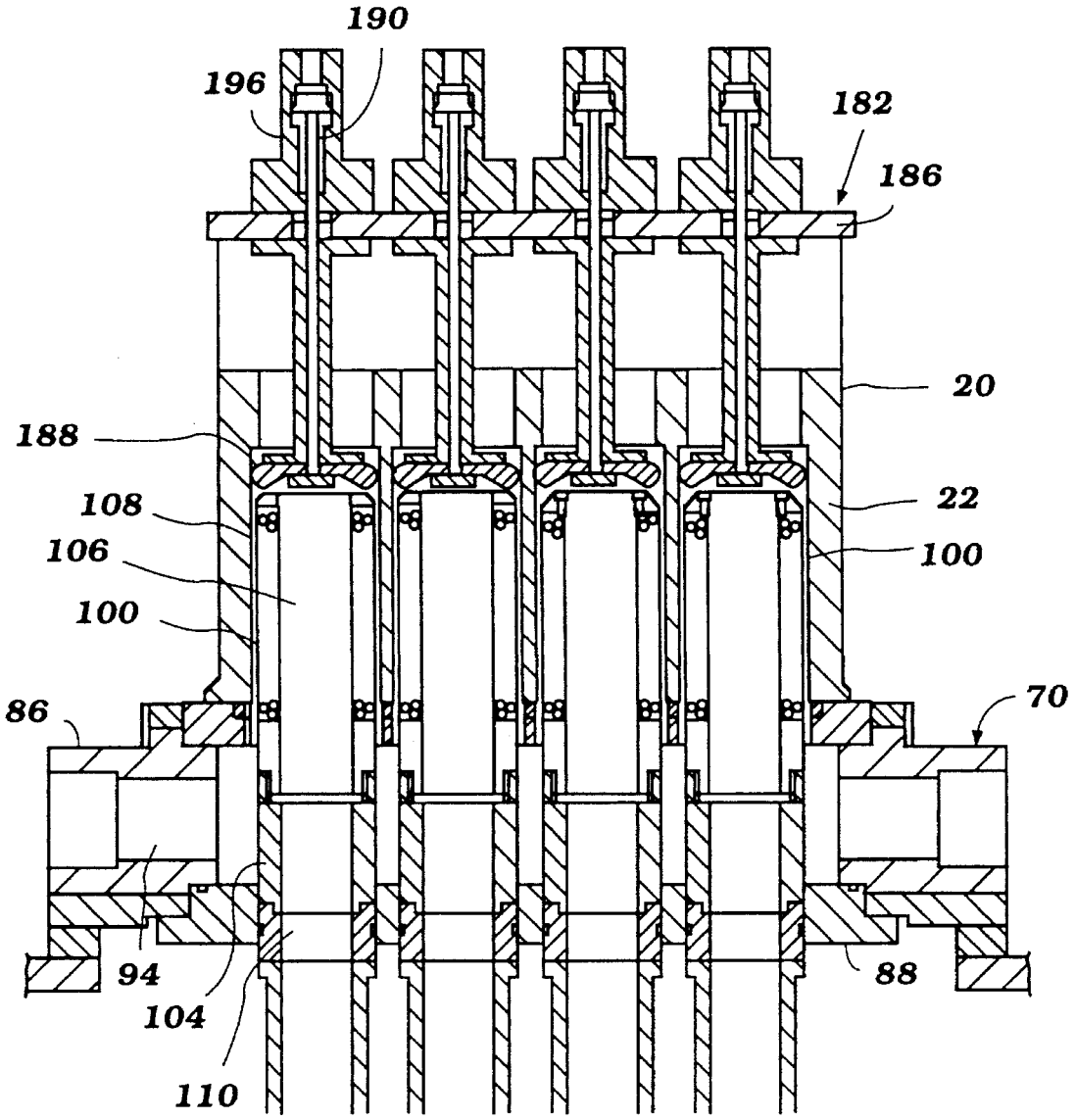
FIG. 17 is a vertical, cross-sectional side view of the pretreatment workstation of FIG. 11.
Figure 18:
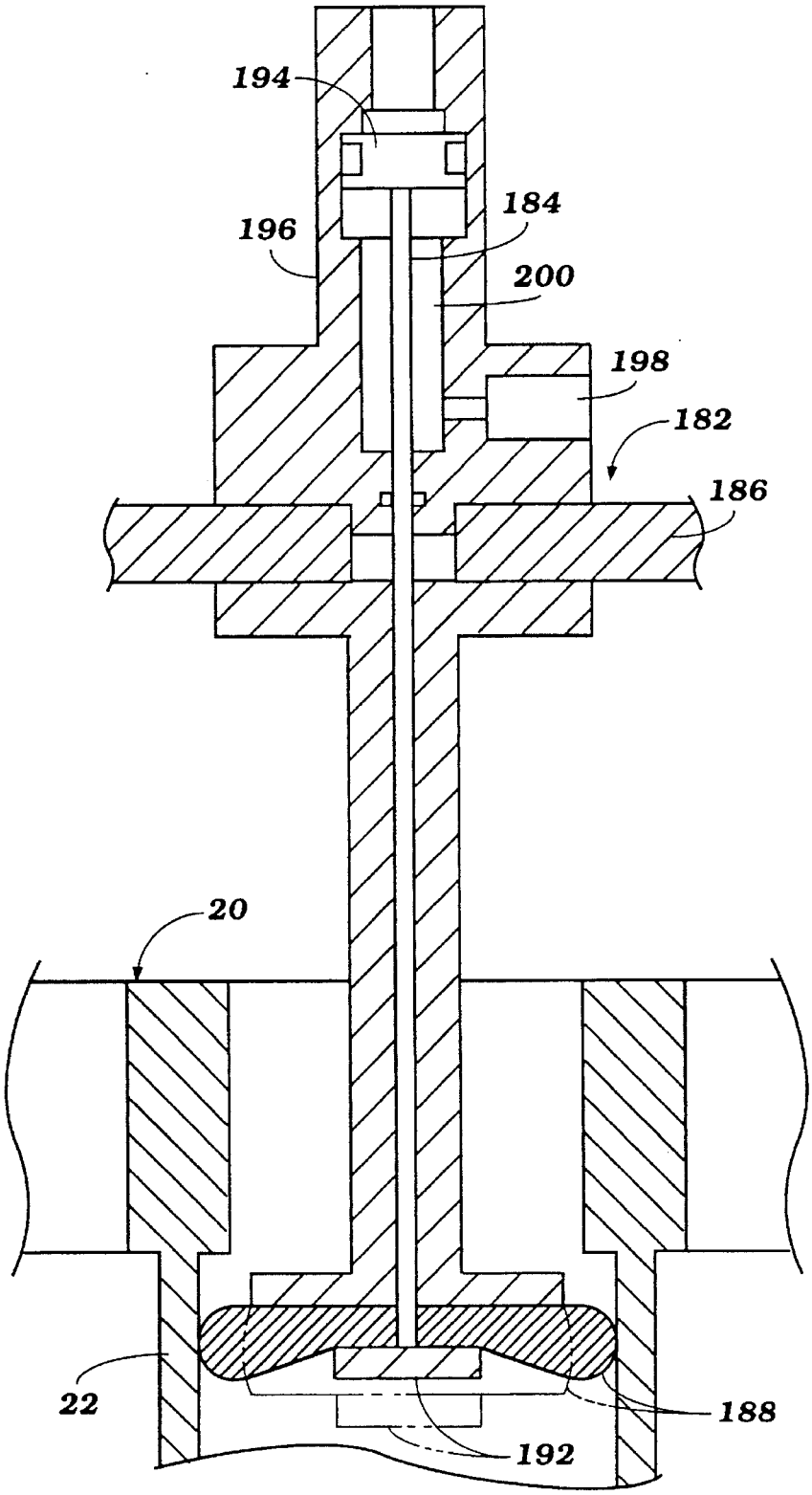
FIG. 18 is an enlarged sectional view showing the sealing mechanism of the workstation of FIG. 16.

FIGS. 16–18 illustrate an alternative sealing mechanism for sealing the upper openings of the cylinder block 20. Specifically, a jig 182 connected to the cylinder block 20 is provided with a number of column members 184 positioned above each of the cylinders of the cylinder block. Each column member 184 extends vertically downward from a plate 186 at the jig 182 which is mounted on the upper end of the cylinder block to a position adjacent the upper openings of the cylinders and is provided at its lower end with a disc-shaped elastic sealing member 188 formed of elastic material, such as rubber.

A tension rod 190 extends through the column member 184 and the elastic sealing member 188 and is movable up and down relative to the jig 182. At the lower end of the tension rod 190 is a plate 192 for exerting force on the inner portion of the disc-shaped sealing member 188. In operation, the movement of the rod 190, and therefore, the plate 192 is controlled by means of a piston 194 which reciprocates up and down in an air cylinder 196 in response to the application of pressurized air through a port 198 and inner chamber 200.

Prior to the application of pressurized air to the air cylinder 196, the elastic sealing member 188 is inserted into the upper opening of the cylinder 22. In this noncompressed state, the elastic sealing member 188 has the shape shown in phantom in FIG. 18. Thereafter, pressurized air is fed to the inner chamber 200 causing the piston 194 to rise and the tension rod 190 to move upward so that the lower plate 192 compresses the sealing member 188 into the form illustrated in FIG. 18.

Figure 19:
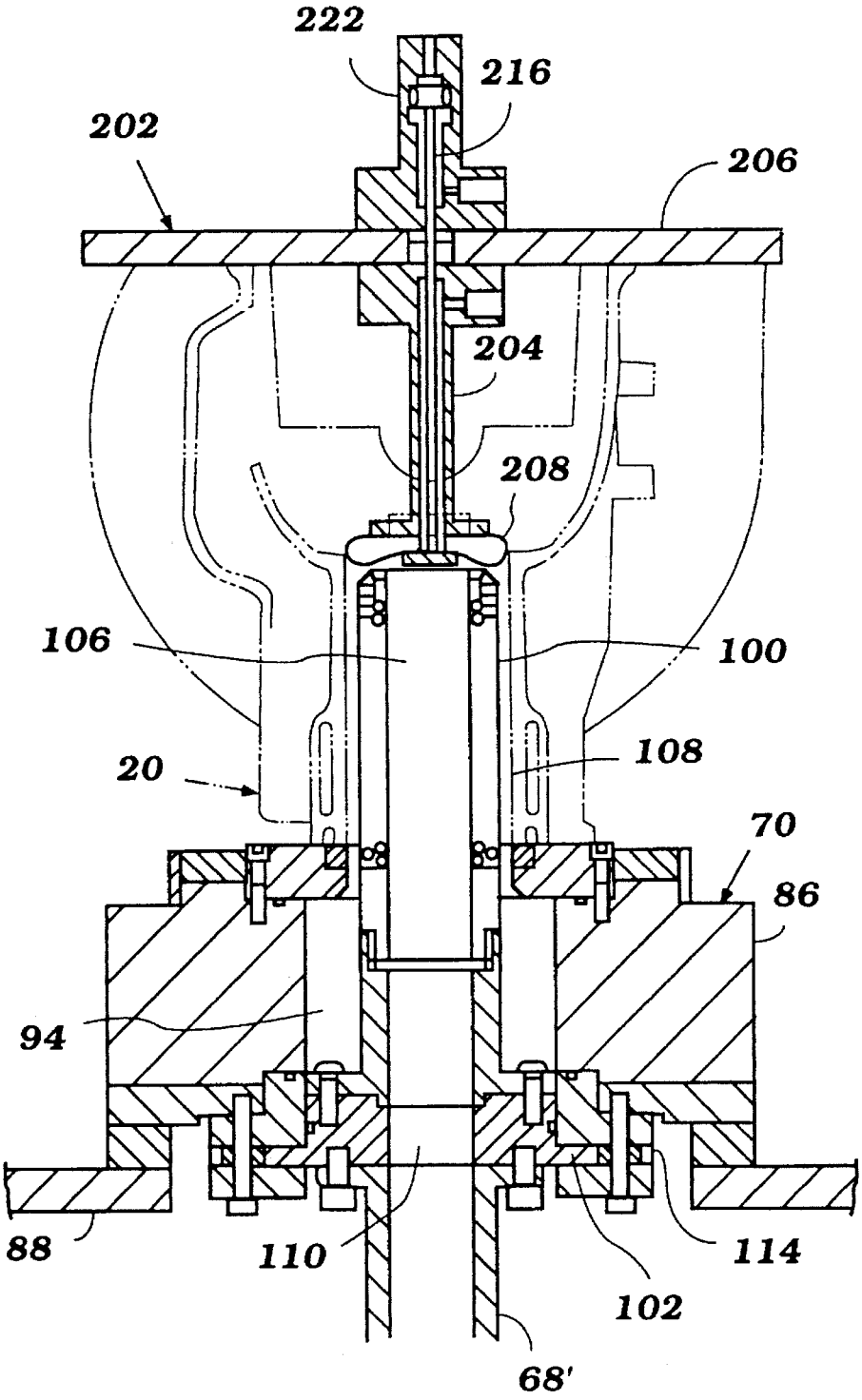
FIG. 19 is an alternative embodiment of a workstation of the present invention.
Figure 20:
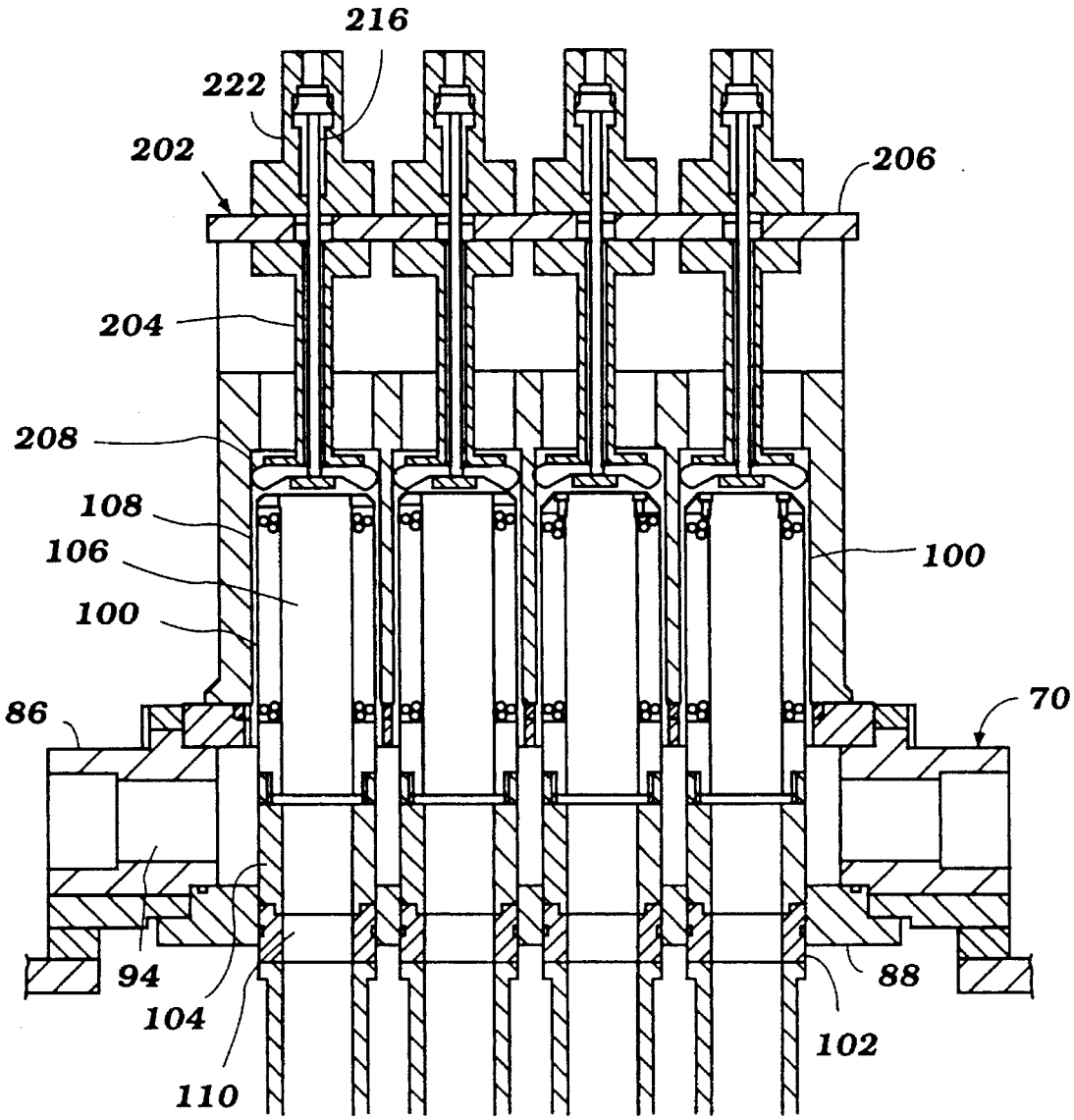
FIG. 20 is an elevational, vertical side view of the workstation of FIG. 19.
Figure 21:
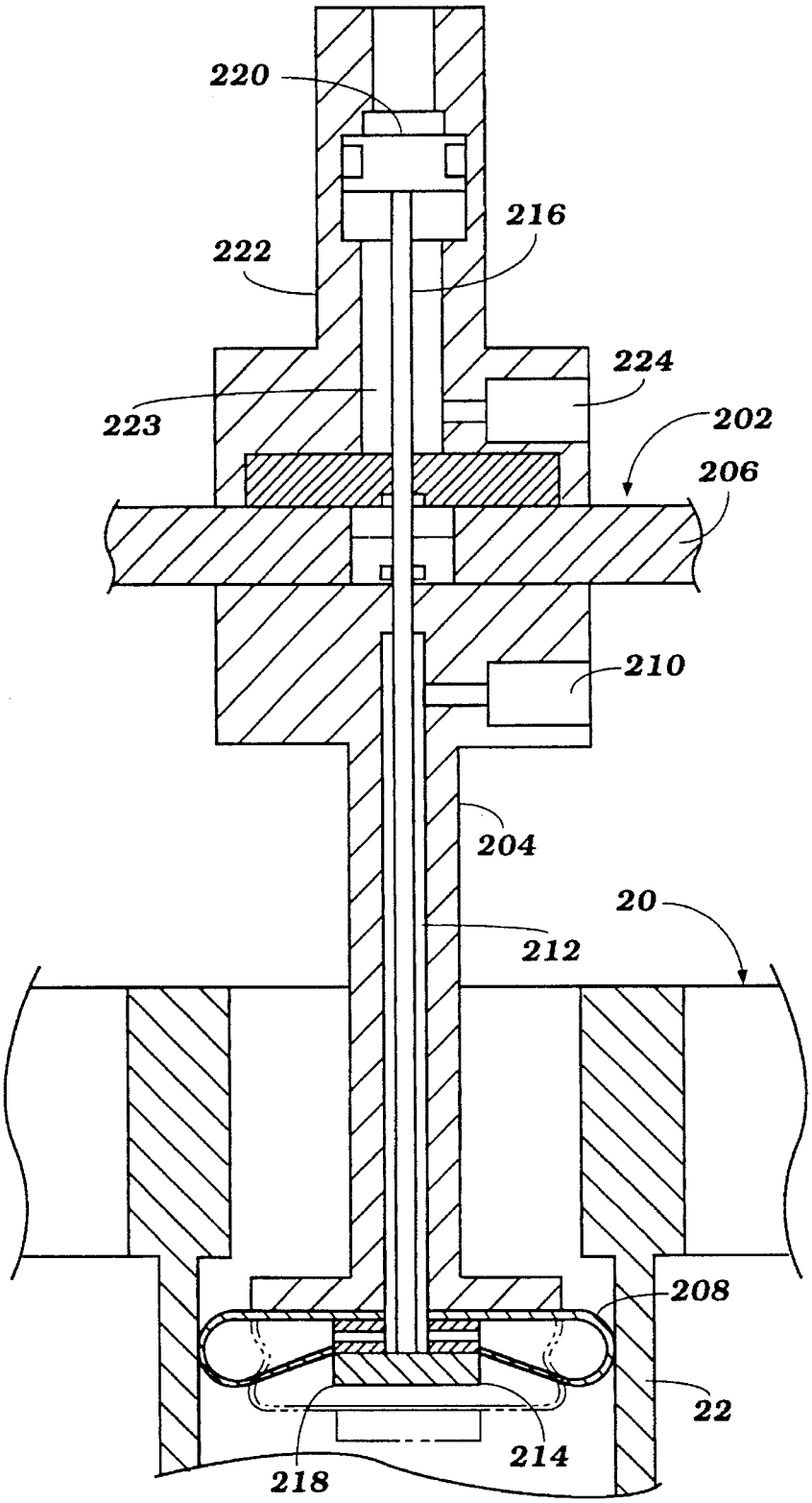
FIG. 21 is an enlarged sectional view of the sealing mechanism of the workstation of FIG. 19.

FIGS. 19–21 illustrate yet another embodiment of the sealing mechanism of the present invention. In this embodiment, a jig 202 is provided with a plurality of column shaped mounts 204 in positions corresponding to the positions of the cylinders of the cylinder block 20. Each mount 204 is secured to a plate 206, which is secured to the upper end of the cylinder block 20 and extends downward to a position adjacent the upper opening of the cylinder. The lower end of each mount 204 is provided with an air bladder, such as a flat tube 208, sized and shaped to sealingly engage the inner cylinder surface of the cylinder 22 when inflated and vertically compressed. Each mount 204 is provided with an air port 210 connected to a pressurized air supply source (not shown) and an air passage 212 which is in fluid communication with the air port extending through the mount. The air passage 212 has a lower end connected to the air tube 208 for fluid communication with the inside of the tube through a communication hole 214 so as to inflate the air tube when pressurized air is applied.

The apparatus further utilizes a tension rod 216 extending through each mount 204 and which is vertically reciprocal with respect to the jig 202. At the lower end of the tension rod 216 is a plate 218 which is positioned at the underside of the air tube 208. At the upper end of the rod 216 is a piston 220 movable within a cylinder 222 having an air chamber 223 in response to pressurized air through a port 224. As will be appreciated, the piston 220 moves upward when pressurized air is applied and downward when the source of pressurized air is removed.

While the seal is effected in this embodiment by means of both inflating the air tube 208 and compressing the air tube by means of the tension rod 216, it would be possible to omit the mechanism for vertically compressing the air tube, relying merely on the force of the air pressure to inflate the air tube to bring it into sealing engagement with the cylindrical surface of the cylinder 22.

Figure 22:
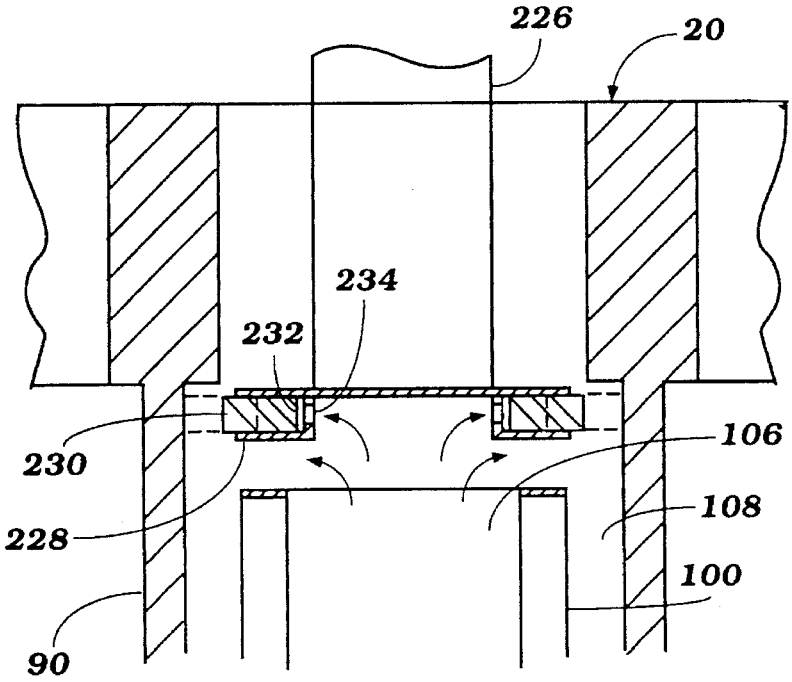
FIG. 22 is an alternative embodiment of a sealing mechanism of the workstation of the present invention.

FIG. 22 illustrates yet another embodiment of a seal mechanism for sealing the upper opening of the cylinder block 20. A downwardly protruding mount 226 is provided with a generally disc-shaped frame 228 within which is mounted a seal element 230. The frame 228 includes a disc-shaped plate and an annular L-shaped flange which cooperates with the plate to form a U-shaped cross-section whose opening is oriented radially outward on the lower peripheral portion of the plate. The seal element may be formed by an elastic annular member such as a rubber ring.

A liquid feeding chamber 232 is defined between the inner diameter of the sealing member 230 and the portion of the frame 228 within the interior of the seal element. The liquid feed chamber 232 has a plurality of liquid feed ports 234 along the inner periphery thereof. In operation, liquid flowing from the interior of the fluid passage defining member 168 enters the plurality of liquid feed ports 234 along the interior surface of the flange causing the sealing member 230 to expand outward into sealing engagement with the inner periphery of the cylinder 22.

As will be appreciated, the direction of the treating liquid flow is opposite to that described in connection with the previously-disclosed embodiments. Specifically, though not specifically illustrated, the path which is in fluid communication with the fluid passage 106 formed inside of the electrode 100 (the path which corresponds to the treating liquid discharge path in the prior embodiment) is connected to the treating liquid feed pipe 66 while the path which is in fluid communication with the fluid passage 108 formed outside of the electrode (the path which corresponds to the treating liquid in the path in FIG. 6) is connected to the treating liquid recovery pipe 68, so that treating liquid is permitted to flow from the fluid passage formed inside the electrode to the fluid passage formed outside thereof. Advantageously, this embodiment permits the sealing mechanism to be operated by utilization of the flowing treatment liquid, so that no separate power source is necessary for the operation of the sealing mechanism.

Figure 23:
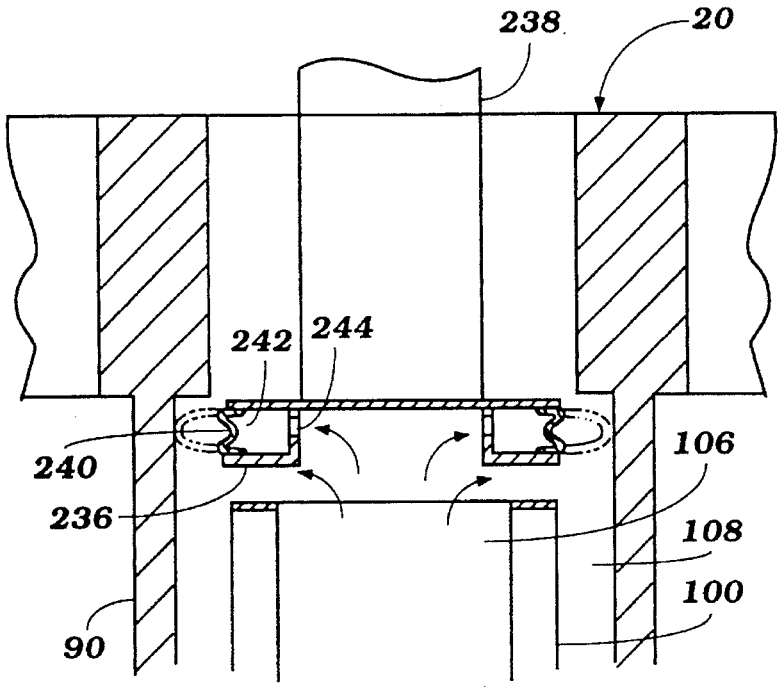
FIG. 23 is another embodiment of the sealing mechanism of the workstation of the present invention.

FIG. 23 discloses yet another embodiment of the sealing mechanism of the present invention. In this embodiment, a supporting frame 236 having a shape substantially similar to the supporting frame 228 disclosed above in connection with the previous embodiment is mounted on a mounting member 238 connected to a jig (not shown) which is secured to the upper end of the cylinder block 20. The supporting frame has a frame portion having a U-shaped cross section to the outer periphery of which is secured an elastic sealing member 240. This sealing member 240 may comprise a partial bladder such as a portion of a rubber tube. A liquid feeding chamber 242 is defined by the sealing member 240 and the portion of the frame 236 positioned radially inward from the seal element. A series of liquid feed ports 244 are provided at the inner periphery of the liquid feeding chamber 242 so that treating liquid flowing through the fluid passages 106, 108 pass through the liquid feed ports into the liquid feeding chamber so that the seal element 240 is expanded outward into pressure contact with the inner cylindrical walls of the cylinder.

FIGS. 24–27 disclose additional alternative embodiments of the sealing mechanism of the present invention in which at least a portion of the sealing mechanism is mounted on the upper end of the electrode 100, or in the case of pretreatment workstations, the fluid passage defining member 168. FIGS. 5, 6 and 8 illustrate a sealing mechanism somewhat resembling the sealing mechanism of FIG. 24 in function. Specifically, an elastic seal element 246 is mounted on the upper end of the electrode 100 (or fluid passage defining member). The sealing mechanism may be mounted by means of supports 248 mounted at an interval around the periphery of the electrode 100. The disc-shaped elastic sealing member 246 is sandwiched between a pair of engagement plates 250. The elastic sealing member 246 has a diameter which is slightly smaller, in an uncompressed state, than the diameter of the bore of the cylinder 22. Advantageously, the jig (not shown) to be connected to the upper end of the cylinder block 20 can be provided with a plunger 252 for pressing the upper engagement plate 250 against the elastic seal element 246 from above causing the upper engagement plate to move downward forcing the elastic sealing member outward into sealing engagement with the cylindrical surface of the cylindrical walls 90.

In this embodiment, the cylinder block 20 is placed over the sealing member 246 so that the sealing member and the electrode 100 are inserted through the cylinder 22 and are positioned adjacent the upper opening of the cylinder. Again, the jig may be provided with an air pressure or otherwise controlled pressing member or plunger 252 to compress the two engagement plates 250 against one another and lead the sealing member 246 into engagement with the upper opened portion of the cylinder 22.

Figure 24:
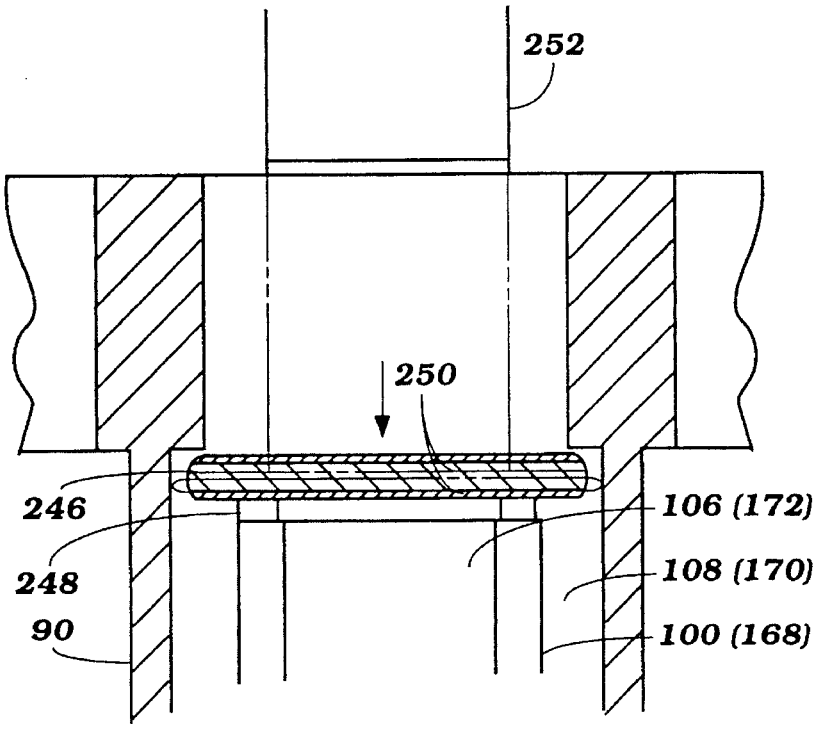
FIG. 24 is an alternative embodiment of the sealing mechanism of the workstation of the present invention.

The embodiment of FIG. 24 is advantageous in that it is easier to insert through the bottom opening of the cylinder 22 (as mounted on the support block) than it would be to insert a sealing member through the upper opening in the crankcase side of the cylinder block when the shape of the crankcase side is complicated. Desirably, the difference between the bore diameter of the cylinder 22 and the diameter of the elastic seal element 246 in an uncompressed state can be made relatively small so as to advantageously reduce the distance the seal element must move from an uncompressed state to form a sealing contact with the cylinder wall.

Figure 25:
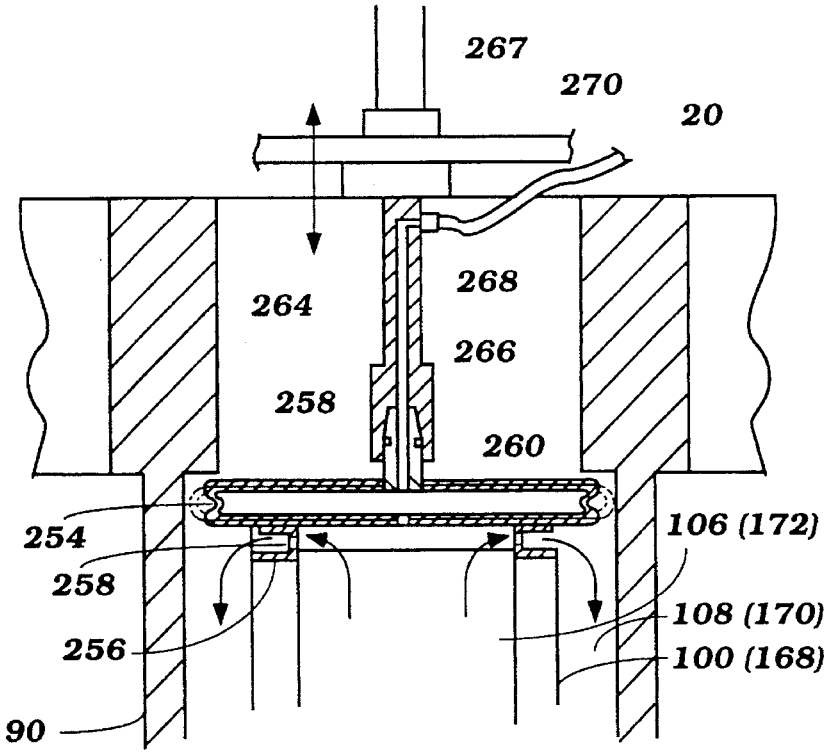
FIG. 25 is an alternative embodiment of the sealing mechanism of the workstation of the present invention.
Figure 26:
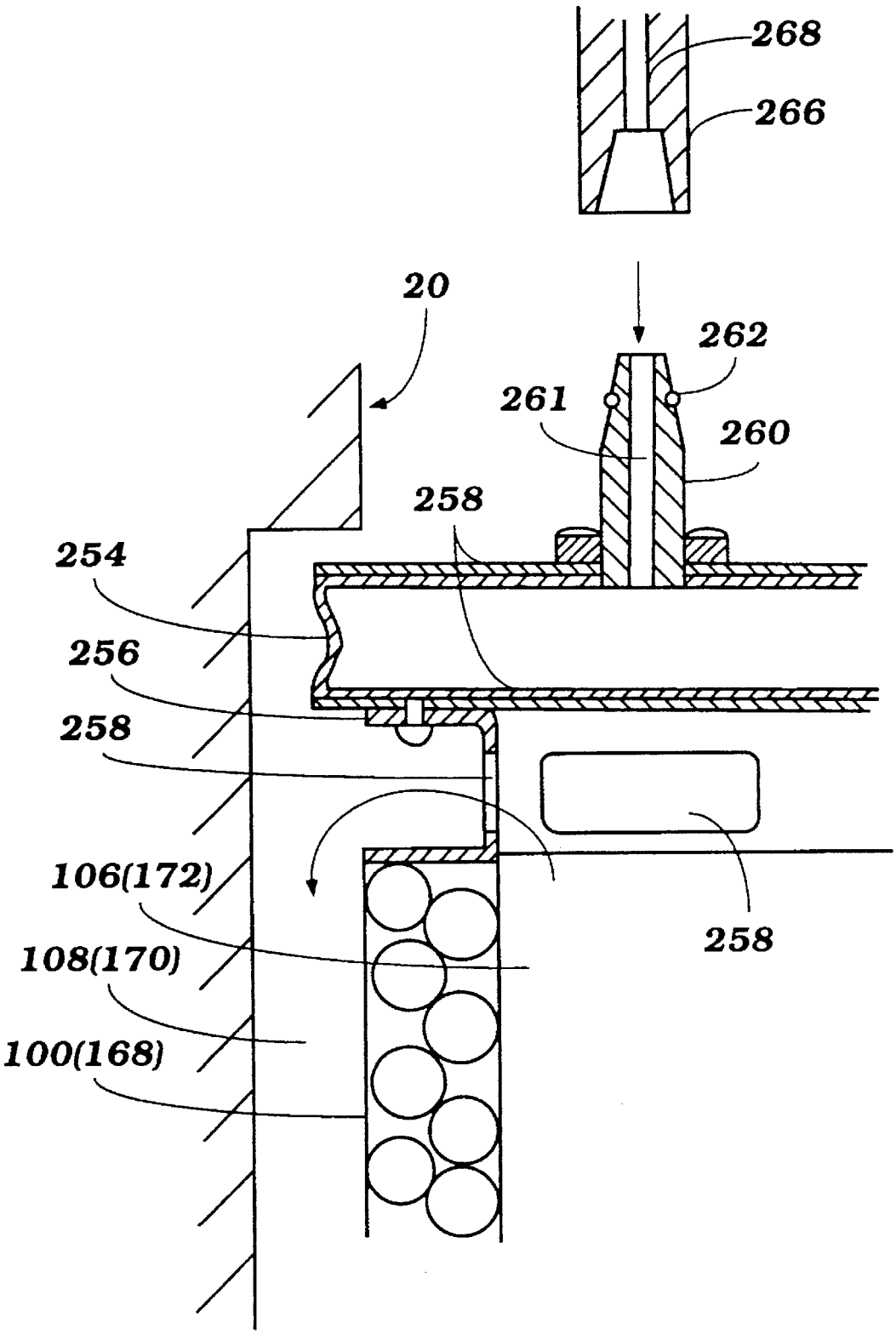
FIG. 26 is an enlarged vertical, sectional view of the sealing mechanism of the workstation of the present invention illustrated in FIG. 25.

FIGS. 25 and 26 illustrate yet another embodiment of the sealing mechanism. This embodiment operates in a manner generally analogous to the embodiment disclosed in FIGS. 19–21, with the exception that certain modifications are necessary because a portion of the seal mechanism is mounted on the electrode 100 (or in pretreatment workstations, on the fluid passage defining member 168). Specifically, a seal element including an inflatable portion, such as an air tube 254 is mounted on the tip of the electrode 100 by means of a mounting frame 256. The mounting frame 256 has a series of liquid feed holes 258 around the inner periphery thereof, the purpose of which will be explained below. The mounting frame 256 is attached to the seal element comprising an air tube 254 secured along the outer circumference of a pair of circular plates 258. The upper plate 258 is provided with a connector 260 defining an air channel 261, such as a male nipple connector. Advantageously, the male connector 260 may be provided with an O-ring mounted 262 along its outer periphery to ensure a fluid-tight seal. The air channel 261 defined by the male connection 260 communicates with a space between the two plates 258, enabling air to be introduced between the plates.

The jig (not shown) connected to the upper end of the cylinder 22 is provided with a rod 264 defining a lower female connector 266 mateable with the male connector 260 of the sealing member. The female connector 266 on the lower end of the rod 264 is moved vertically upward or downward out of or into sealing engagement with the male connector 260 by an air cylinder 267. The rod 264 defines an air channel 268 for communicating with the air channel 261 of the male connector 260 of the seal element 254. The air channel 268 of the rod 264 is further connected to a hose 270 connected to a source of pressurized air (not shown).

In this embodiment, when the cylinder block 20 is mounted on the workstation main body, the seal element 254 on the end of the electrode 100 is positioned within the upper end of the cylinder 22. The rod 264 is then moved downward by operation of the air cylinder 267 so that the female connector 266 at the lower end of the rod is brought into sealing engagement with the male connector 260 secured to the seal element 254 and pressurized air is fed from the pressurized air source to the seal element, thereby inflating the air tube, causing the seal element to form a sealing engagement with the inner cylindrical surface of a cylinder 22.

In the embodiments shown in FIGS. 24–26, the upper end of the cylinder block 20 need not be connected to a jig, such as when the jig is omitted because of the use of a transferring device described hereinafter. In this situation, the seal actuator, such as the plunger or the cylinder and rod can be secured to the upper portion of the workstation main body. Desirably, when this is the case, the seal operating means components are retracted sideward when the cylinder block is to be moved.

Figure 27:
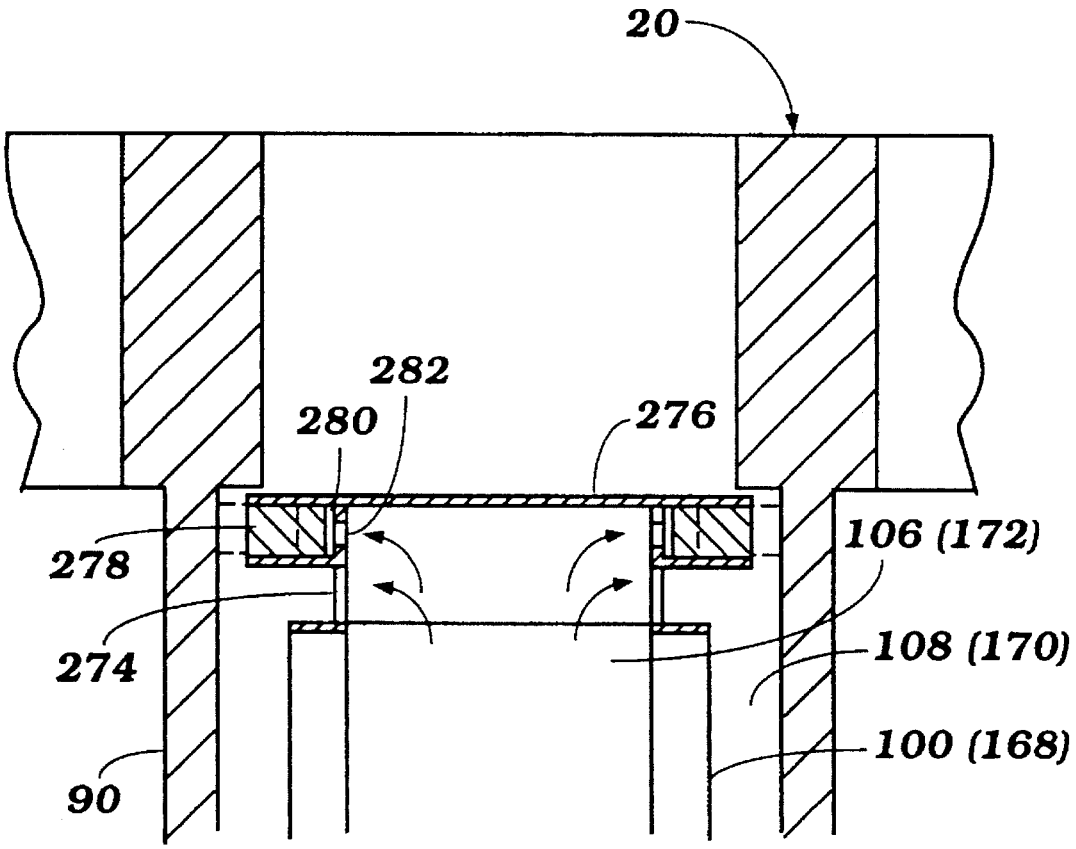
FIG. 27 is an alternative embodiment of the sealing mechanism of the workstation of the present invention.

FIG. 27 discloses yet another embodiment of the seal mechanism of the present invention. This embodiment is analogous to the embodiment shown in FIG. 22 in function, with certain modifications due to the seal element being secured to the upper end of the electrode 100 (or in the case of a preworkstation, the fluid passage defining member 168). Specifically, referring to FIG. 27, a mount including upwardly extending portions 274 is secured to the upper end of the electrode 100 and a support frame 276 is secured to the mount. The support frame 276 is defined by a circular disk and a depending L-shaped flange which cooperates with the outer peripheral portion of the disk to form a channel having a U-shaped cross section. An elastic seal element 278 is fitted within the channel. The inner periphery of the seal element 278 is advantageously slightly larger than the vertical wall portion of the L-shape flange so that the seal element and the support frame 276 define a liquid feed chamber 280. The vertical wall of the L-shaped flange is provided with a series of liquid inlets 282, enabling liquid to flow into the liquid feed chamber 280. When fluid flows out of the inner fluid path 106 defined by the electrode 100, it is deflected by the disk portion of the frame member 276 and forces the seal element 278 radially outward. Advantageously, this embodiment provides both a sealing member and the seal actuator entirely on the side of the electrode 100 (or in the case of a pretreatment section, the side of the fluid passage defining member 168). Advantageously, this significantly simplifies the structure.

The structure for the seal of the upper open portion of the cylinder 22 as shown in the foregoing embodiments, may be applicable to both the plating treatment section and the pretreatment section. In the plating treatment section E, however, the use of the above seal mechanism is highly important so as to improve the flow of the plating liquid toward the inside surface of each of the cylinders 22 and to improve the quality of the plating by preventing the plating liquid from depositing, except for on the required portions. In the pretreatment section, on the other hand, deposition of a slight amount of treating liquid on the crankcase of the cylinder block 20 is permissible. Therefore, the structure may be simplified by using an overflow system as shown in FIGS. 28 and 29.

Figure 14:
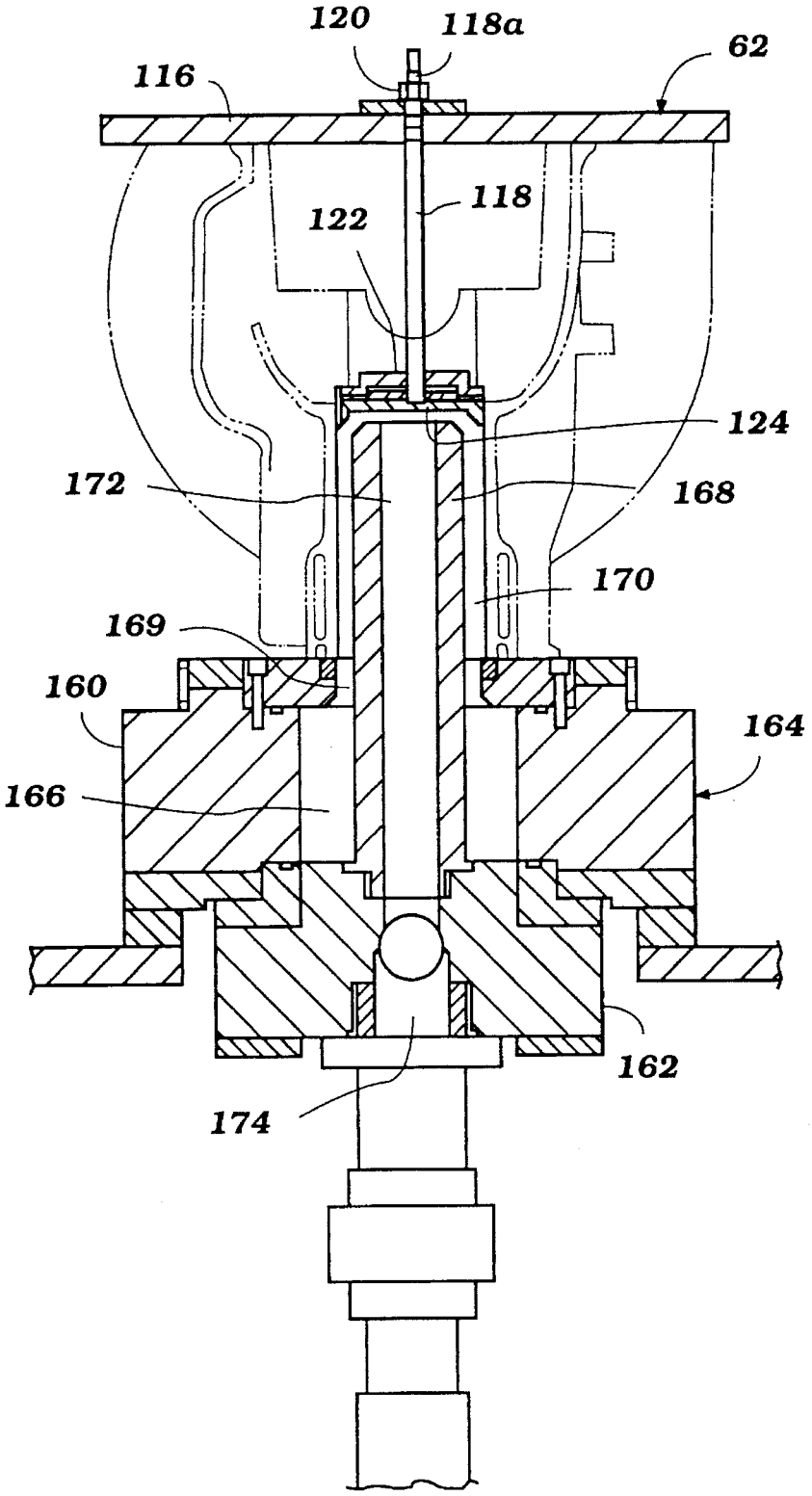
FIG. 14 is a vertical, cross-sectional view of a pretreatment workstation of the system of FIG. 1.
Figure 15:
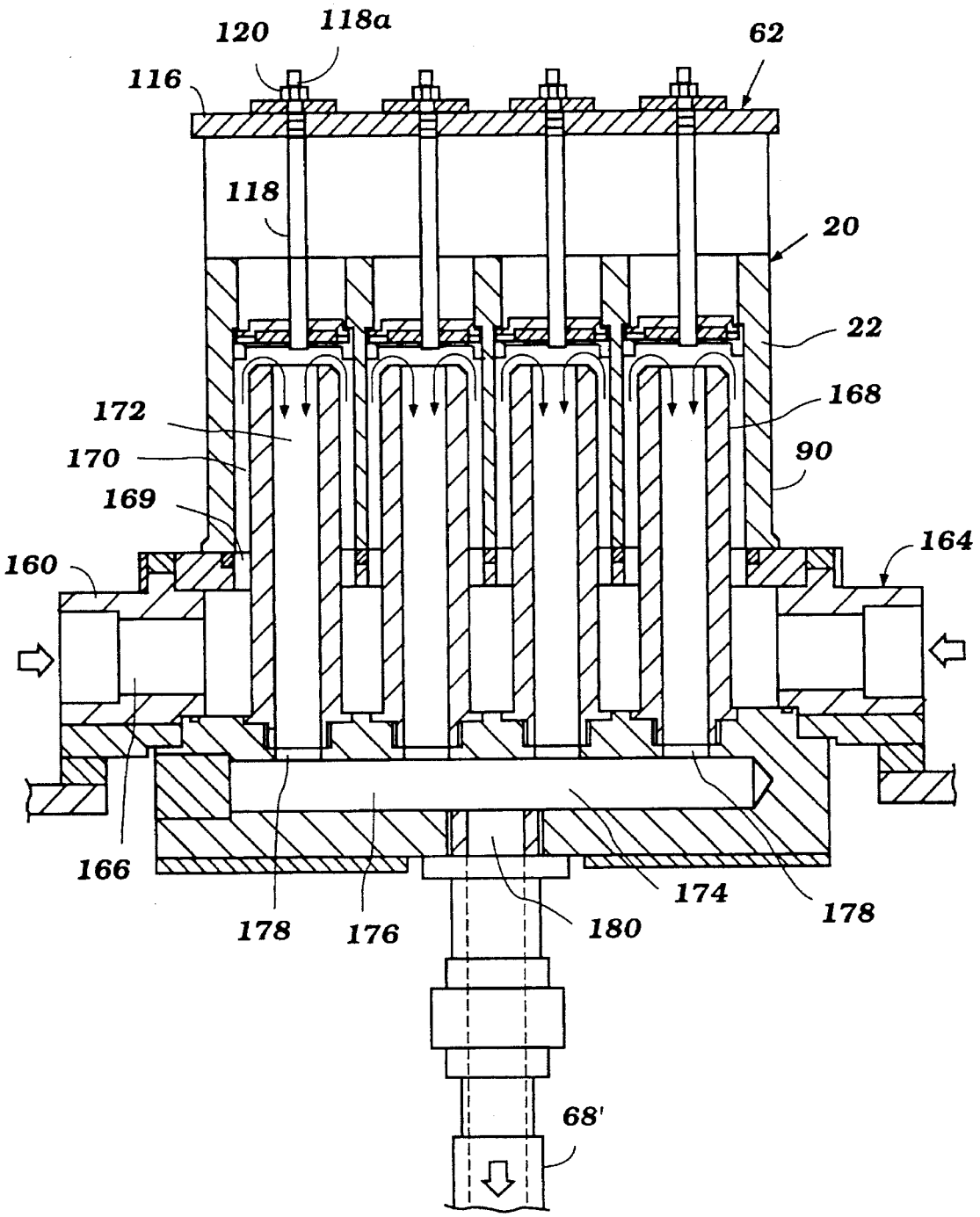
FIG. 15 is a side, cross-sectional view of the pretreatment workstation of FIG. 14.
Figure 28:
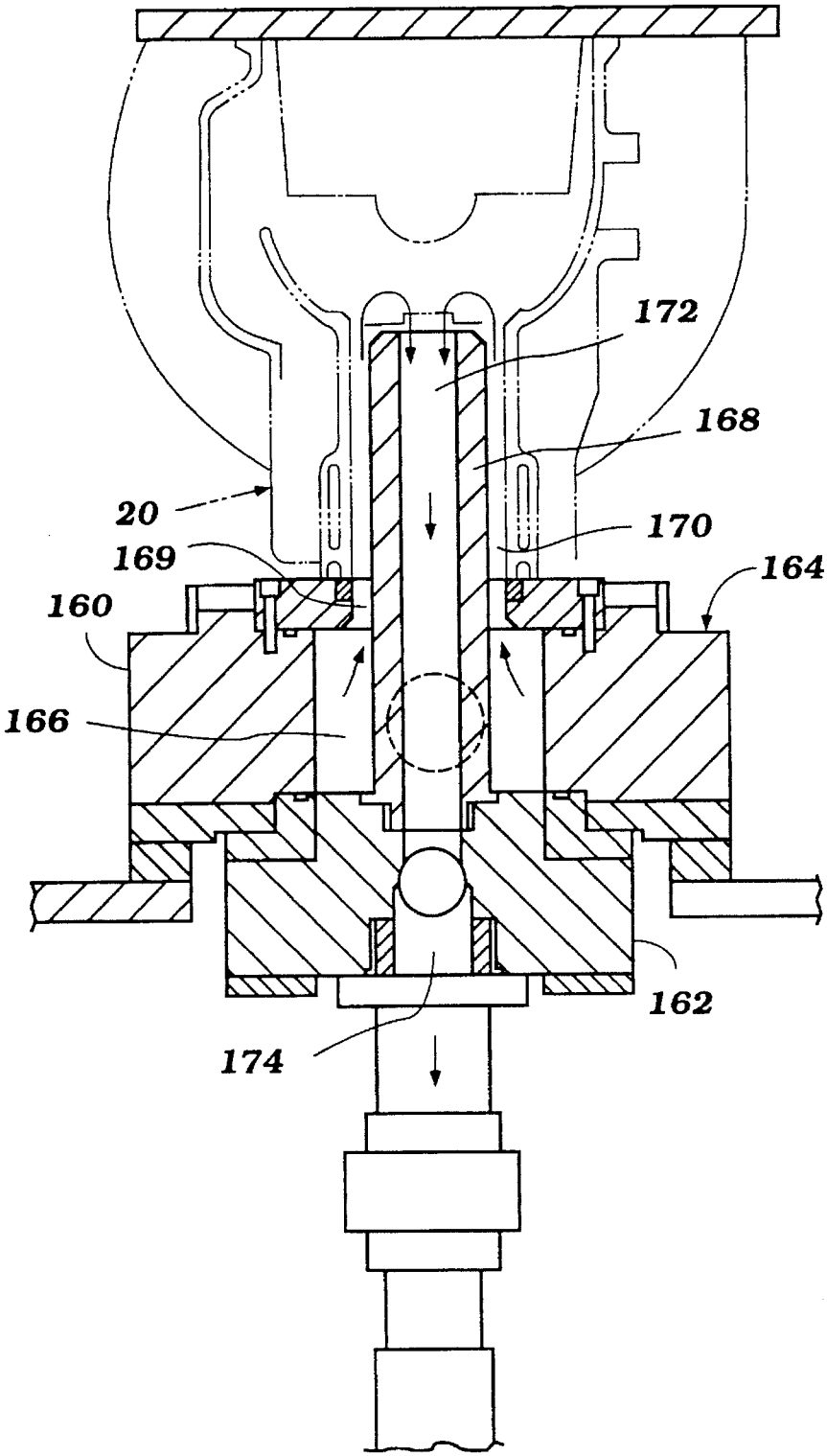
FIG. 28 is a vertical, cross-sectional front view of an alternative embodiment of the pretreatment workstation of the present invention.
Figure 29:
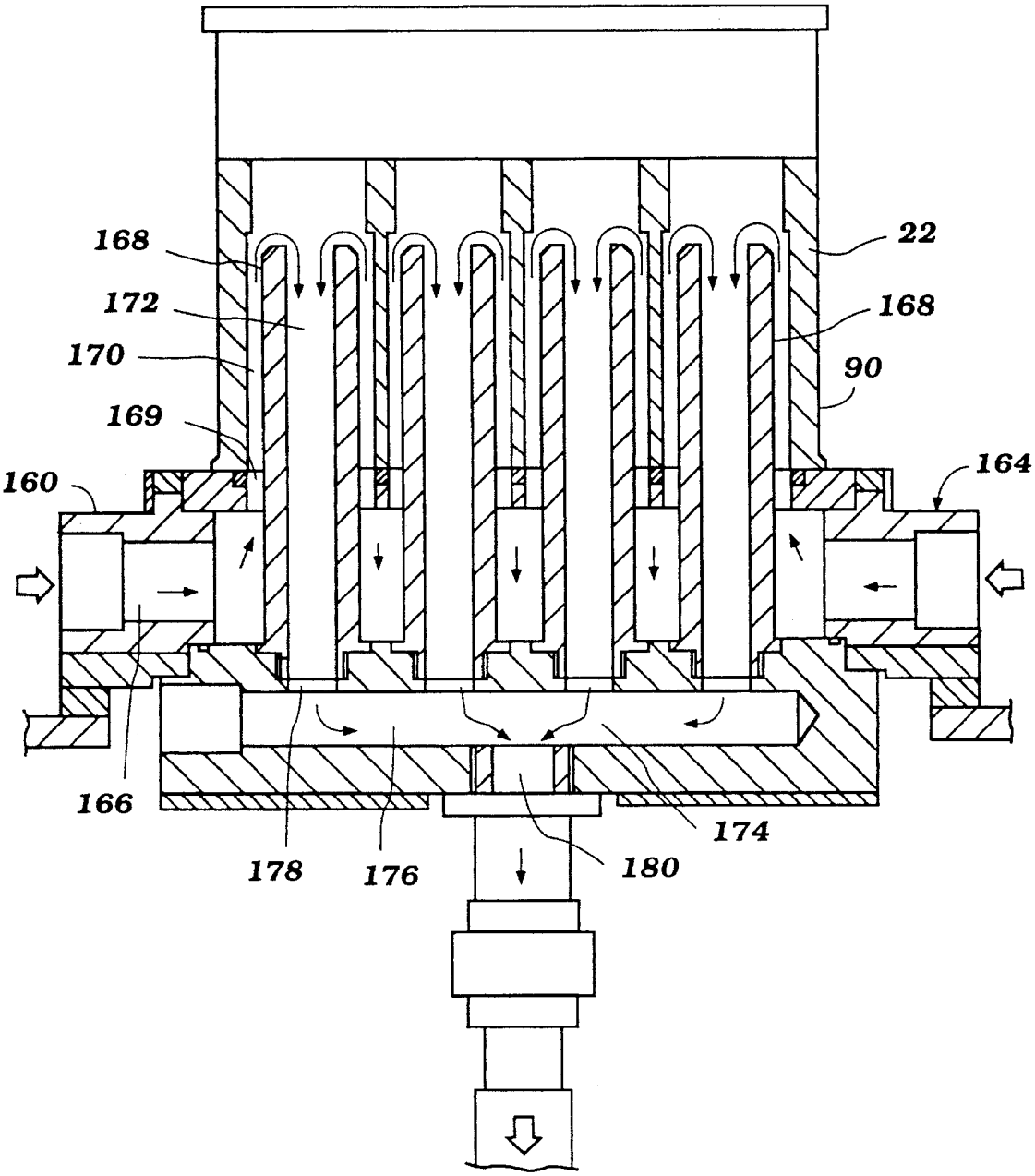
FIG. 29 is a vertical, cross-sectional side view of the pretreatment workstation of FIG. 14.

Thus, in FIGS. 28 and 29, a seal mechanism is omitted from the upper open portion of each of the cylinders 22 of the cylinder block 20, though the structure of the treatment device main body 70 is similar to that shown in FIGS. 14 and 15.

Specifically, the treating liquid is fed through the treating liquid feed path 166 by a treating liquid feed pump, through the fluid passage between the fluid passage-defining member 168 and the interior surface of the cylinder 22, and overflows from the upper end of the fluid passage-defining member and into the inner fluid passage 172, and thereafter is discharged to the treating liquid recovery pipe 68' through the treating liquid discharge path 174. The valves 74 and 76 (FIG. 3) provided in the treating liquid feed and discharge system control the feed rate of the treating liquid, thereby maintaining the feed rate of the treating liquid to prevent excessive spillage.

Figure 30:
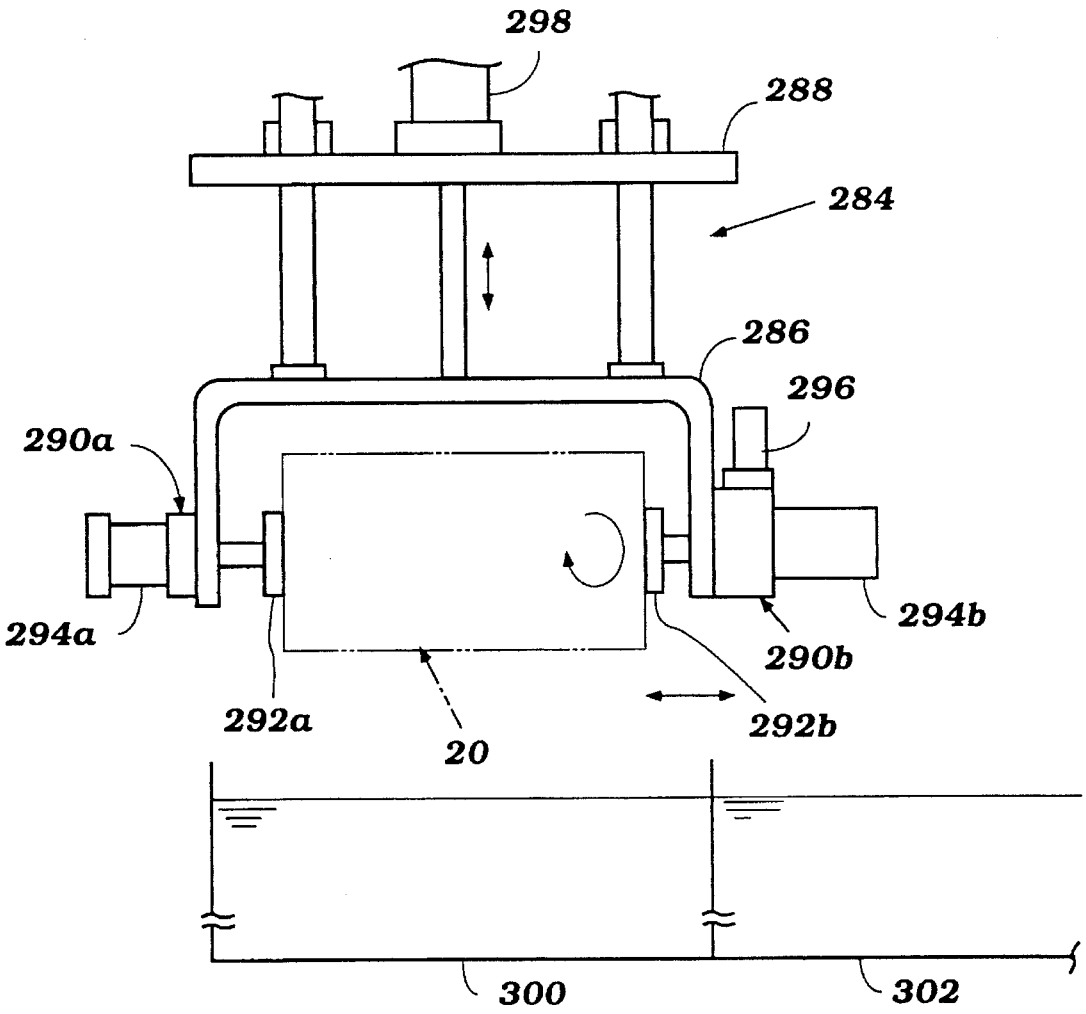
FIG. 30 is an alternative embodiment of the workpiece transfer device of the system of the present invention.

The modified work transfer device will now be described. Specifically, FIG. 30 illustrates a work transfer device 284 movable along the transfer line and having a frame 286 vertically movably supported on a support section 288. A pair of left and right chuck mechanisms 290*a*, 290*b* are mounted to the frame 286. The chuck mechanisms 290*a,b* have work chucks 292*a*, 292*b* capable of protruding and retracting at the opposite sides of the frame 286 and air cylinders 294*a*, 294*b* for driving the work chucks for clamping. By operation of the air cylinders 294*a,b*, the cylinder block 20 is clamped from both sides with the work chucks 292*a,b*. The chuck mechanisms 290*a,b* are each rotatably mounted on the frame 286 and are rotatable through an angle of 180 degrees by operation of an air cylinder 296 through a rack and pinion (not shown). The frame 286 is likewise movable up and down by means of an air cylinder 298.

The modified work transfer device 284 eliminates the need for a transfer jig 62 and permits the elimination of the jig mounting and dismounting workstations.

The cylinder block 20 is moved between a work supporting station (not shown) movably mounted with respect to the vessels and the work transfer device 188 through recovering 300 and washing vessels 302. When the cylinder block 20 is complicated in shape, however, the amount of water taken from the vessels 300, 302 tends to increase. Advantageously, however, the air cylinder 296 can be used to rotate the chuck mechanisms 290*a,b* and the cylinder block 20 clamped therein through 180 degrees to return much of the lost water to the vessels 300, 302, thereby minimizing the loss of water.

The systems, assembly, workstation, and method of the present invention may also be used in connection with certain additional workstation improvements, the details of which are set forth in a U.S. patent application entitled "Surface Treatment Device," Serial Number unknown, filed on even date herewith (claiming priority from Japanese Patent Application No. 218755, filed Sep. 2, 1993), which is also hereby incorporated herein by reference. Likewise, the system, assembly, workstation, and method of the present invention are desirably used in connection with an improved plating liquid in accordance with various process parameters, the details of which are set forth in a U.S. patent application entitled "Plating Liquid, Plating Method, and Engine Cylinder Having Plated Interior Surface," serial number unknown, filed on even date herewith (claiming priority from Japanese Patent Application No. 218753, filed Sep. 2, 1993), which is hereby incorporated herein by reference.

We claim:

1. An assembly for treating a cylinder bore of a cylinder block having a cylinder head engaging surface at one end thereof and surrounding said cylinder bore to form a first opening and a skirt portion at the other end of said cylinder block forming in part a crankcase chamber and defining a second opening at the other end of said cylinder bore, comprising a body defining a support upon which the cylinder head engaging surface of said cylinder block is secured, a sealing surface connected to said body to form a seal around said first opening when said cylinder block is secured to said support, an open-ended tubular member carried by said support and extending into a cylinder bore of a cylinder block secured to said support and terminating short of said second opening, said tubular member defining a fluid passage extending through the interior of said tubular member radially at said second opening and axially along the outer periphery of said tubular member and the inner periphery of said cylinder bore, said fluid passage defining a treating liquid feed end and a treating liquid discharge end, a treating liquid feed channel connected to said treating liquid feed end of said member, a treating liquid discharge channel connected to said treating liquid discharge end of said member, a source of pressure communicating with one of said feed channel and said discharge channel to circulate liquid within said assembly, and a sealing mechanism at least partially insertable into said second opening for sealing said second opening.

2. The assembly of claim 1, wherein said sealing mechanism further comprises a sealing element expandable radially outward to form a seal with said cylinder bore.

3. The assembly of claim 2, wherein said sealing mechanism further comprises an actuator for selectively exerting pressure on said sealing element to cause said sealing element to engage said interior surface to form a seal.

4. The assembly of claim 1, further comprising a jig securable to said cylinder block skirt portion and the sealing mechanism comprises a sealing element carried by said jig.

5. The assembly of claim 4, wherein said sealing element is expandable radially outward to form a seal with said cylinder bore.

6. The assembly of claim 4, further comprising an actuator for selectively exerting pressure on said sealing element to cause said sealing element to engage said cylinder bore to form a seal.

7. The assembly of claim 6, wherein said sealing element is expandable radially outward to form a seal with said cylinder bore.

8. The assembly of claim 2, wherein said sealing mechanism comprises an engaging plate engageable with an edge portion of said cylinder block skirt portion, a seal pressing plate opposite said engaging plate, a sealing element comprised of elastic material positioned between said engaging plate and said seal pressing plate, and an actuator comprises a rod connected to said seal pressing plate and means for displacing said rod in such a direction that said seal pressing plate approaches said engaging plate, whereby said elastic sealing material expands radially outward into sealing engagement with said cylinder bore.

9. The assembly of claim 4, wherein said sealing mechanism comprises:

a disk-shaped elastic sealing element attached to said jig through a mount such that said elastic sealing member is located inside of said cylinder bore and an actuator comprising a tension member for applying a compressing force to said elastic sealing member in an axial direction, and means for operating said tension member.

10. The assembly of claim 4, wherein said seal mechanism includes a flat air tube attached to said jig through a mount member such that the air tube is located inside of the cylinder bore of said workpiece and an actuator including an air feeding and discharging means for feeding compressed air to said air tube, thereby imparting an inflating force to said air tube.

11. The assembly of claim 7, wherein said sealing mechanism comprises an annular elastic body capable of radially expanding and shrinking and secured by a supporting frame attached to said jig such that said elastic body is located inside of said cylinder when said jig is connected to said cylinder block and an actuator comprising a liquid feed chamber defined inside of said elastic body secured by said supporting frame and a liquid introduction port formed in the supporting frame such that treating liquid flowing within the cylinder bore when the cylinder block is supported on said support is permitted to be introduced into the liquid feed chamber causing said elastic body to be outwardly expanded by pressure of said treating liquid flowing into said liquid feed chamber.

12. The assembly of claim 2, wherein the surface treatment to an inside peripheral surface of a cylindrical portion of work, comprising a body including a support for supporting a workpiece such that an opened portion of one side of the cylinder of the workpiece such that an opened portion of one side of the cylinder of the workpiece is closed, a member defining a fluid passage for treating liquid within the inside of the cylindrical portion of the work, a treating liquid feed channel communicating with said fluid passage, a treating fluid discharge channel in communication with said fluid passage, means for pressurizing treating liquid within said treating liquid feed channel, wherein the sealing member comprises a sealing device attached to the end of said tubular member within said cylinder bore, and a seal operating means for imparting an outwardly expanding force to said sealing device to maintain the outer periphery of the sealing device in pressure engagement with the cylinder bore adjacent said second opening.

13. The assembly of claim 12, wherein said sealing device includes a plate-like elastic sealing element attached to an upper end of said tubular member and wherein said seal operating means includes a pressing member for applying a compressing force to said elastic sealing element in the lengthwise direction of said member, and means for operating said pressing member.

14. The assembly of claim 12, wherein said sealing device includes a flat air tube attached to an upper end of said tubular member and wherein said seal operating means includes air feeding and discharging means for feeding compressed air to said air tube, thereby imparting outwardly inflating force to the air tube.

15. The assembly of claim 12, wherein said sealing device comprises an annular elastic body capable of radially expanding and shrinking and secured by a supporting frame attached to said tubular member and wherein said seal operating means includes a liquid feeding chamber defined inside of said elastic body secured by said supporting frame, and a liquid introduction port formed in the supporting frame such that a part of the treatment liquid which flows within the cylinder bore is permitted to be introduced into said liquid feeding chamber so that said elastic body is outwardly expanded by pressure of said treating liquid.

* * * * *